US008330373B2

(12) United States Patent
Ramer et al.

(10) Patent No.: US 8,330,373 B2
(45) Date of Patent: Dec. 11, 2012

(54) PHOSPHOR-CENTRIC CONTROL OF COLOR CHARACTERISTIC OF WHITE LIGHT

(75) Inventors: David P. Ramer, Reston, VA (US); Jack C. Rains, Jr., Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 82 days.

(21) Appl. No.: 12/729,542

(22) Filed: Mar. 23, 2010

(65) Prior Publication Data

US 2011/0175546 A1 Jul. 21, 2011

Related U.S. Application Data

(60) Provisional application No. 61/304,560, filed on Feb. 15, 2010.

(51) Int. Cl.
*H01J 17/34* (2006.01)

(52) U.S. Cl. ..... 315/32; 362/166; 362/230; 362/231

(58) Field of Classification Search ..... 315/291, 315/32; 362/166, 230, 231
See application file for complete search history.

(56) References Cited

U.S. PATENT DOCUMENTS

| | | | | |
|---|---|---|---|---|
| 3,636,341 | A | 1/1972 | Miller | |
| 5,502,626 | A | 3/1996 | Armstrong et al. | |
| 5,549,844 | A | 8/1996 | Bringley et al. | |
| 5,753,918 | A | 5/1998 | Pandelisev | |
| 5,851,428 | A | 12/1998 | Matsuda et al. | |
| 6,969,843 | B1 | 11/2005 | Beach et al. | |
| 7,058,103 | B2 | 6/2006 | Ishida et al. | |
| 7,144,131 | B2 | 12/2006 | Rains | |
| 7,148,632 | B2 | 12/2006 | Berman et al. | |
| 7,481,553 | B2 | 1/2009 | Kim et al. | |
| 7,618,157 | B1 * | 11/2009 | Galvez et al. | 362/294 |
| 7,768,192 | B2 | 8/2010 | Van De Ven et al. | |
| 7,845,825 | B2 | 12/2010 | Ramer et al. | |
| 7,889,421 | B2 | 2/2011 | Narendran et al. | |
| 8,016,470 | B2 | 9/2011 | Li et al. | |
| 2004/0012027 | A1 | 1/2004 | Keller et al. | |

(Continued)

FOREIGN PATENT DOCUMENTS

WO WO 01/66997 A2 9/2001

(Continued)

OTHER PUBLICATIONS

United States Office Action issued in U.S. Appl. No. 12/940,634 dated Mar. 22, 2011.

(Continued)

*Primary Examiner* — Douglas W Owens
*Assistant Examiner* — Jianzi Chen
(74) *Attorney, Agent, or Firm* — McDermott Will & Emery LLP

(57) ABSTRACT

Lighting systems and devices offer dynamic control or tuning of a color characteristic, e.g. color temperature, of white light. The exemplary lighting systems and devices are used for general lighting applications that utilize solid state sources to pump remotely deployed phosphors. Two or more phosphors emit visible light of different visible spectra, and these spectra are somewhat broad, e.g. pastel, so that combinations thereof can approach white light temperatures including points along the black body curve. Independent adjustment of the intensities of electromagnetic energy emitted by the solid state sources adjusts levels of excitations of the phosphors, in order to control a color characteristic of the visible white light output of the lighting system or device.

20 Claims, 9 Drawing Sheets

U.S. PATENT DOCUMENTS

| | | | | |
|---|---|---|---|---|
| 2004/0257807 | A1 | 12/2004 | Endo et al. | |
| 2005/0093430 | A1 | 5/2005 | Ibbetson et al. | |
| 2005/0156103 | A1 | 7/2005 | May et al. | |
| 2005/0161586 | A1 | 7/2005 | Rains et al. | |
| 2006/0068154 | A1 | 3/2006 | Parce et al. | |
| 2006/0291226 | A1 | 12/2006 | Daicho et al. | |
| 2007/0024173 | A1 | 2/2007 | Braune | |
| 2007/0235639 | A1 | 10/2007 | Rains, Jr. | |
| 2007/0291505 | A1 | 12/2007 | Fortenberry et al. | |
| 2008/0084706 | A1 | 4/2008 | Roshan et al. | |
| 2008/0224025 | A1 | 9/2008 | Lyons et al. | |
| 2008/0237540 | A1 | 10/2008 | Dubrow | |
| 2008/0246017 | A1 | 10/2008 | Gillies et al. | |
| 2009/0002986 | A1 | 1/2009 | Medendorp, Jr. et al. | |
| 2009/0290352 | A1 * | 11/2009 | Wu et al. | 362/294 |
| 2010/0002414 | A1 | 1/2010 | Meir et al. | |
| 2010/0172120 | A1 | 7/2010 | Wegh et al. | |
| 2011/0127557 | A1 | 6/2011 | Ramer et al. | |
| 2011/0128718 | A1 | 6/2011 | Ramer et al. | |
| 2011/0176289 | A1 | 7/2011 | Ramer et al. | |
| 2011/0176316 | A1 | 7/2011 | Phipps et al. | |

FOREIGN PATENT DOCUMENTS

| | | | |
|---|---|---|---|
| WO | WO 2009/137053 | A1 | 11/2009 |
| WO | WO 2009/146261 | A1 | 12/2009 |
| WO | WO 2009/146262 | A1 | 12/2009 |
| WO | WO 2010/012999 | A2 | 2/2010 |

OTHER PUBLICATIONS

United States Notice of Allowance issued in U.S. Appl. No. 12/629,614 dated Aug. 5, 2010.

International Search Report and Written Opinion of the International Searching Authority issued in International Patent Application No. PCT/US2011/024783, mailed May 31, 2011.

Transmittal of International Search Report and Written Opinion of the International Searching Authority issued in International Patent Application No. PCT/US2010/058716 dated May 24, 2011.

Transmittal of International Search Report and Written Opinion of the International Searching Authority issued in International Patent Application No. PCT/US2011/024789 dated May 27, 2011.

Transmittal of International Search Report and Written Opinion of the International Searching Authority issued in International Patent Application No. PCT/US2011024787 dated May 27, 2011.

United States Office Action issued in U.S. Appl. No. 12/729,582 dated Sep. 22, 2011.

United States Office Action issued in U.S. Appl. No. 12/940,634 dated Aug. 10, 2011.

US Office Action issued in U.S. Appl. No. 12/836,022 dated Jun. 22, 2012.

International Preliminary Report on Patentability issued in International PCT/US2010/028247 dated Jun. 14, 2012.

International Preliminary Report on Patentability issued in International PCT/US2010/058716 dated Jun. 14, 2012.

United States Notice of Allowance issued in U.S. Appl. No. 12/729,582 dated Mar. 2, 2012.

United States Notice of Allowance issued in U.S. Appl. No. 12/940,634 dated Feb. 17, 2012.

United States Office Action, issued in U.S. Appl. No. 12/836,022, dated Jan. 26, 2012.

* cited by examiner 10
14
14a
11
16
12
A
A
L
L
L

Wavelength (nm)

Wavelength (nm)

PHOSPHOR-CENTRIC CONTROL OF COLOR CHARACTERISTIC OF WHITE LIGHT

RELATED APPLICATIONS

This application claims the benefit of U.S. Provisional Application No. 61/304,560 Filed Feb. 15, 2010 entitled "Dynamic Control of Color Characteristics of Light Using Solid State Source and Phosphors," the disclosure of which also is entirely incorporated herein by reference.

TECHNICAL FIELD

The present subject matter relates to dynamically controlling or tuning of color characteristics of light, for example, the color temperature of white light, produced by lighting systems including fixtures and lamps for general lighting applications that utilize solid state sources to pump phosphors.

BACKGROUND

Recent years have seen a rapid expansion in the performance of solid state lighting devices such as light emitting devices (LEDs); and with improved performance, there has been an attendant expansion in the variety of applications for such devices. For example, rapid improvements in semiconductors and related manufacturing technologies are driving a trend in the lighting industry toward the use of light emitting diodes (LEDs) or other solid state light sources to produce light for general lighting applications to meet the need for more efficient lighting technologies and to address ever increasing costs of energy along with concerns about global warming due to consumption of fossil fuels to generate energy. LED solutions also are more environmentally friendly than competing technologies, such as compact florescent lamps, for replacements for traditional incandescent lamps.

The actual solid state light sources, however, produce light of specific limited spectral characteristics. To obtain white light of a desired characteristic and/or other desirable light colors, one approach uses sources that produce light of two or more different colors or wavelengths and one or more optical processing elements to combine or mix the light of the various wavelengths to produce the desired characteristic in the output light. One technique involves mixing or combining individual light from LEDs of three or more different wavelengths (spectral colors such as "primary" colors), for example from Red (R), Green (G) and Blue (B) LEDs. With a LED-centric approach such as LED based RGB, the individual color amounts can be adjusted easily to a wide range of colors, including different color temperatures of white light, in the fixture output. There are applications where the ability to adjust or 'tune' the color of white light is desirable. However, with the approach using LEDs of three different monochromatic colors, the output spectrum tends to have a small number of narrow spikes, which produces a low color rendering index (CRI). An LED system can actually be designed to somewhat mimic a desired CRI rating, by careful selection of the LED colors to meet the CIE color test components, yet the LED light output may provide less than optimal illumination of some colors on objects or in areas illuminated by the LED lighting system. It is possible to improve the CRI by providing additional LEDs of different colors, but that approach increases complexity and overall system cost.

Another LED-centric approach to white lighting combines a white LED source, which tends to produce a cool bluish light, with one or more LEDs of specific wavelength(s), such as red and/or yellow, chosen to shift a combined light output to a more desirable color temperature. Adjustment of the LED outputs offers control of intensity as well as the overall color output, e.g. color and/or color temperature of white light. However, even this approach may have some narrow spiking in the emission spectrum, e.g. due to the red and/or yellow LED light used to correct the color temperature, and as a result, the color rendering may still be less than desirable.

In recent years, techniques have also been developed to shift or enhance the characteristics of light generated by solid state sources using phosphors, including for generating white light using LEDs. Phosphor based techniques for generating white light from LEDs, currently favored by LED manufacturers, include UV or Blue LED pumped phosphors. In addition to traditional phosphors, semiconductor nanophosphors have been used more recently. The phosphor materials may be provided as part of the LED package (on or in close proximity to the actual semiconductor chip), or the phosphor materials may be provided remotely (e.g. on or in association with a macro optical processing element such as a diffuser or reflector outside the LED package). The remote phosphor based solutions have advantages, for example, in that the color characteristics of the fixture output are more repeatable, whereas solutions using sets of different color LEDs and/or lighting fixtures with the phosphors inside the LED packages tend to vary somewhat in light output color from fixture to fixture, due to differences in the light output properties of different sets of LEDs (due to lax manufacturing tolerances of the LEDs).

However, where some control of color characteristic is provided, it is provided by additional dynamically controllable LEDs. The controlled LEDs used for tuning may be specific color LEDs or substantially white LEDs of one or more color temperatures selected to adjust the light color characteristic of light produced by pumping of the phosphor. Like the LED-centric tuning of the white LED with a specific color, however, LED centric tuning of the phosphor emissions may have some narrow spiking in the emission spectrum, and as a result, the color rendering may still be less than desirable.

Solid state lighting technologies have advanced considerably in recent years, and such advances have encompassed any number of actual LED based products, however there is still room for further improvement in the context of lighting products. For example, it is desirable to provide a light output spectrum that generally conforms to that of the lighting fixture or lamp the solid state lighting device may replace. As another example, it may be desirable for the solid state lighting device to provide a tunable color light output of color. It may also be useful for such a device to provide intensity and output distribution that meet or exceed expectations arising from the older replaced technologies. Relatively acceptable/pleasing form factors similar to those of well accepted lighting products may be desirable while maintaining advantages of solid state white lighting, such as relatively high dependability, long life and efficient electrical drive of the solid state light emitters.

SUMMARY

The detailed description and drawings disclose a number of examples of tunable white light emitting systems, which utilize a phosphor-centric approach to color characteristic control and are intended to address one, some or all of the needs for improvements and/or provide some or all of the commercially desirable characteristics outlined above.

For example, a disclosed solid state lighting device might include first and second solid state sources both for emitting electromagnetic energy of the same first narrow spectrum and first and second optical elements arranged to receive electromagnetic energy from the first and second solid state source, respectively. However, the second optical element is arranged to receive little or no electromagnetic energy from the first solid state source, and the first optical element is arranged to receive little or no electromagnetic energy from the second solid state source. The exemplary lighting device includes two or more phosphors. A first of the phosphors is in the first optical element at a location for excitation by the electromagnetic energy from the first solid state source, whereas a second phosphor is in the second optical element at a location for excitation by the electromagnetic energy from the second solid state source. The first phosphor is of a type excitable by electromagnetic energy of the first spectrum, and when excited, for emitting visible light of a second spectrum different from and broader than the first spectrum. The second phosphor is of a type excitable by electromagnetic energy of the first spectrum, but when excited, for emitting visible light of a third spectrum different from and broader than the first spectrum. The third spectrum also is different from the second spectrum. The visible light output of the device includes a combination of light of the second spectrum from excitation of the first phosphor and light of the third spectrum from excitation of the second phosphors, from the first and second optical elements. The visible light output of the lighting system is at least substantially white. Also, the first and second solid state sources are independently controllable so that the visible white light output of the solid state lighting device has a spectral characteristic determined by respective intensities of the electromagnetic energy of the first spectrum emitted by the first and second solid state sources, which determine relative levels of excitations of the first and second phosphors.

A system as disclosed herein may include some or all of the elements of the solid state lighting device in combination with a controller coupled to the first and second solid state sources. The controller enables adjustment of respective intensities of the electromagnetic energy of the first spectrum emitted by the first and second solid state sources to adjust relative levels of excitations of the first and second phosphors, to control the spectral characteristic of the visible white light output of the lighting system.

In at least some of the examples, for a set of respective intensities of the electromagnetic energy emitted by the first and second solid state sources, the relative levels of excitations of the first and second phosphors produce visible white light output of the lighting system corresponding to a point on the black body curve. At least when the visible white light output corresponds to such a point on the black body curve, the white output light may have a color rendering index (CRI) of 75 or higher and/or may have a color temperature in one of the following ranges: 2,725±145° Kelvin; 3,045±175° Kelvin; 3,465±245° Kelvin; and 3,985±275° Kelvin. However, control of the respective excitation energy supplied to the respective phosphors from the sources enables tuning of the color temperature from a rated temperature as or when desired, for example, to correspond to other points on or somewhat off of the black body curve.

In the examples, the first and second solid state sources are narrowband sources each having an emission rating wavelength $\lambda$ at or below about 460 nm. A variety of phosphors are discussed for use in the phosphor-centric tunable white lighting devices or systems, including semiconductor nanophosphors such as quantum dots and doped semiconductor nanophosphors. A variety of phosphor deployment techniques are also discussed.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
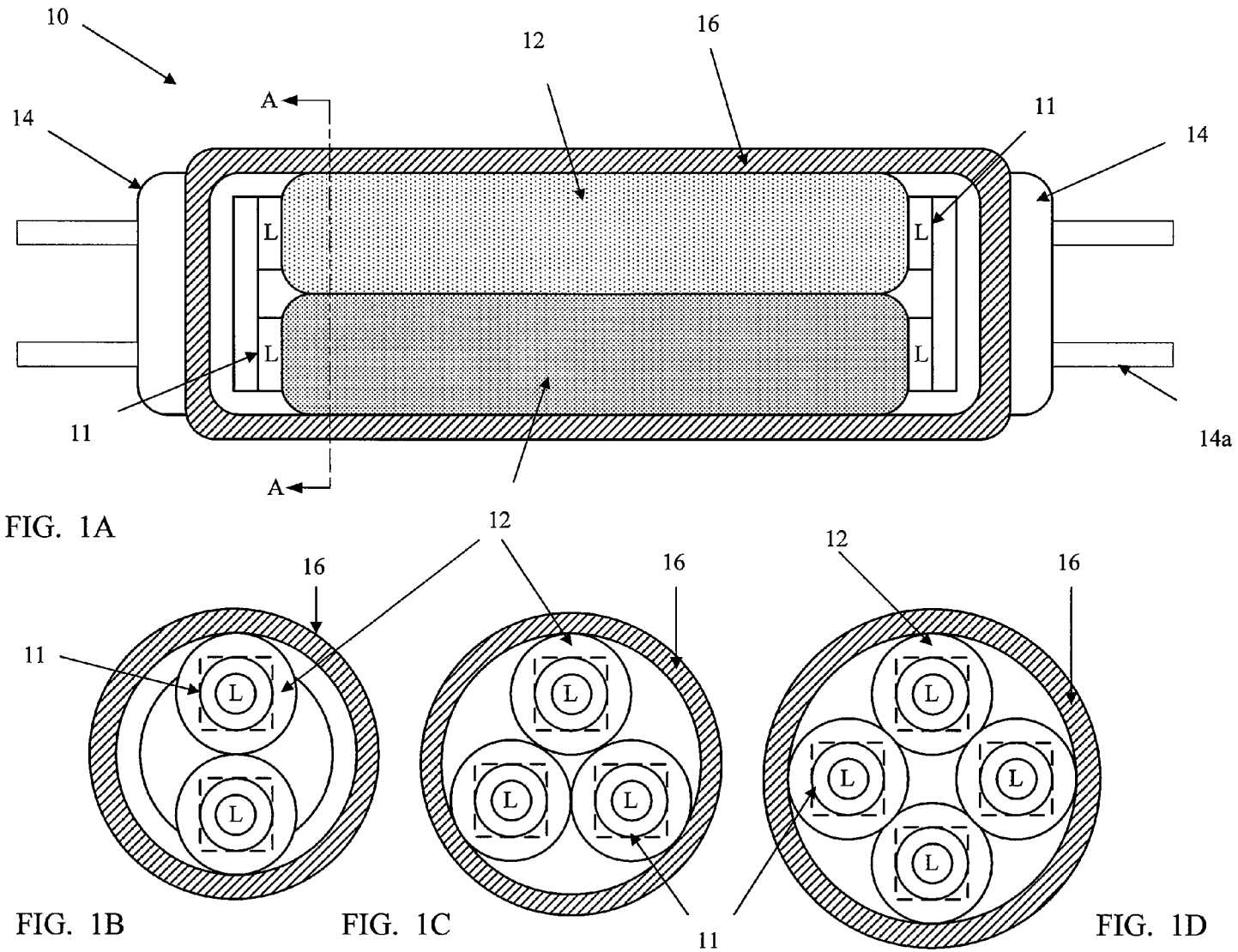
FIG. 1A is a cross-sectional view of a tunable white light emitting device, with certain elements thereof shown in cross-section.
FIGS. 1B-1D are cross-sectional views of the tunable white light emitting device in FIG. 1A containing two, three and four light guides, respectively.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples discussed below relate to solid state lighting devices or systems incorporating such devices, enabling dynamic controlling or tuning of a color characteristic, e.g. color temperature, of white light for general lighting applications. The lighting systems and devices utilize separately controllable solid state sources to pump phosphors. Two or more phosphors emit visible light of different visible spectra, and these spectra are somewhat broad, e.g. pastel, so that combinations thereof can approach white light temperatures along the black body curve. Independent adjustment of the intensities of electromagnetic energy emitted by the solid state sources adjusts levels of excitations of the phosphors, in order to control a color characteristic of the visible white light output of the lighting system or device, e.g. to change the characteristic(s) of the white light output to correspond to a different point on the black body curve or to a point on the color gamut somewhat off of the black body curve.

In the examples, the solid state sources are configured to emit light or other electromagnetic energy of the same spectrum, in that they are rated for the same spectral output, e.g. rated for the same main wavelength output, although in actual lighting devices there may be some variation from source to source for example within manufacturer's tolerances.

The solid state sources and respective optical elements containing the different phosphors are arranged so that each source supplies electromagnetic energy to excite the phosphor in the respective optical element but supplies little or no electromagnetic energy to excite the phosphor in any other optical element. Stated another way, an optical element receives energy from an associated solid state source to excite the phosphor in that element, but little or no energy from a source associated with any of the other optical elements. In actual practice, there may be some leakage or cross-talk of the pumping energy from one solid state source over from one associated optical element to another optical element. However, the solid state sources and optical elements are arranged to keep any such cross-talk of potential pumping energy sufficiently low as to enable a level of independent control of the phosphor excitations to allow the degree of light tuning necessary for a particular tunable lighting application. For a tunable white lighting application, for example, the optical separation needs only to be sufficient to enable the optical tuning from one white light color temperature to another, e.g. from a spectral characteristic corresponding to one point roughly on the black body curve to another spectral characteristic corresponding to a different point roughly on the black body curve.

Although sometimes referred to below simply as white light for convenience, the light produced by excitation of the phosphors may be considered "at least substantially" white when it appears as visible white light to a human observer, although it may not be truly white in the electromagnetic sense in that it may exhibit some spikes or peaks and/or valleys or gaps across the relevant portion of the visible spectrum and/or may differ from a black body spectrum for white light.

The phosphor-centric tunable white lighting technologies discussed herein, including lamps, light fixtures and systems, can be configured for general lighting applications. Examples of general lighting applications include downlighting, task lighting, "wall wash" lighting, emergency egress lighting, as well as illumination of an object or person in a region or area intended to be occupied by one or more people.

As discussed herein, applicable solid state light emitting elements or sources essentially include any of a wide range of light emitting or generating devices formed from organic or inorganic semiconductor materials. Examples of solid state light emitting elements include semiconductor laser devices and the like. Many common examples of solid state sources, however, are classified as types of "light emitting diodes" or "LEDs." This exemplary class of solid state sources encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs having two, three or more LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state sources may include one or more phosphors and/or quantum dots, which are integrated into elements of the package or light processing elements of the fixture to convert at least some radiant energy to a different more desirable wavelength or range of wavelengths.

The examples use one or more LEDs to supply the energy to excite the nanophosphors. The solid state source in such cases may be the collection of the LEDs. Alternatively, each LED may be considered a separate solid state source. Stated another way, a source may include one or more actual emitters.

With that instruction, reference now is made in detail to the examples illustrated in the accompanying drawings and discussed below.

FIG. 1A illustrates a first example of a tunable light emitting device 10. The example represents a lamp product, specifically, a tube lamp, although fixture examples are discussed later. As discussed more later, electronic circuitry is combined with the device 10, to control the sources and thus control or tune the output. The combination of the light emitting device with the appropriate electronics forms a light emitting system. The device and/or the system is configured for tunable white lighting applications, including any of a variety of general lighting applications. Hence, further discussion of the example of FIG. 1A will refer to the device 10 as a white light emitting device.

The white light emitting device 10 includes a number of optical elements 12 comprising containers formed of an optically transmissive material and containing a material bearing a phosphor. The optical elements are not drawn to scale but instead are sized in the drawings in a manner to facilitate review and understanding by the reader. As will become apparent from later discussion of this example, each such optical element forms an optical guide with respect to energy from one or more sources 11 but allows diffuse emission of light produced by emissions of the phosphors excited by the energy from the sources.

The exemplary tunable white light emitting device 10 therefore includes a solid state source 11 positioned at each end of each of a plurality of light guides 12. Two light guides 12 are illustrated in FIG. 1A, three light guides are illustrated in FIG. 1C, and four light guides illustrated in FIG. 1D. FIGS. 1B-1D are cross sections of the tunable white light emitting device 10 along line A-A containing two, three and four light guides 12, respectively. The light guides 12 are housed within an outer container 16 with end caps 14 and metal prongs 14*a* for insertion into a compatible light socket. The outer container 16 is similar to that of a florescent tube housing and may present a similar outer tubular form factor. The circuitry (not shown) used to drive the solid state sources 11 may be contained within the caps 14, although if the tube device 10 is configured for a fixture similar to that for a florescent lamp, then the circuitry would likely be contained in a separate ballast like housing. An example of the circuitry is described in further detail with respect to FIG. 11.

The lighting device 10 utilizes solid state sources 11, rated for emitting electromagnetic energy of a first emission spectrum, in the examples, at a wavelength in the range of 460 nm and below ($\lambda \leqq 460$ nm). The solid state sources 11 in FIGS. 1A-1D can include near ultraviolet (UV) solid state sources, containing a semiconductor chip for producing near UV electromagnetic energy in a range of 380-420 nm. A semiconductor chip produces electromagnetic energy in the appropriate wavelength range, e.g. at 405 nm which is in the near ultraviolet (UV) range of 380-420 nm. Remote semiconductor nanophosphors, typically doped semiconductor nanophosphors, are remotely positioned in containers 12 so as to be excited by this energy from the solid state sources 11. Each phosphor is of a type or configuration such that when excited by energy in range that includes the emission spectrum of the sources 11, the semiconductor nanophosphors together produce light in the output of the device 10 that is at least substantially white.

The upper limits of the absorption spectra of the exemplary nanophosphors are all at or below 460 nm, for example, around 430 nm although phosphors with somewhat higher upper limits of their absorption spectra are contemplated. A more detailed description of examples of phosphor materials that can be used is described later. The system incorporating the device 10 could use LEDs or other solid state devices emitting in the UV range, the near UV range or a bit higher, say up to around or about 460 nm. For discussion purposes, we will assume that the emission spectrum of the sources in the near UV range of 380-420 nm, say 405 nm LEDs.

Figure 2:
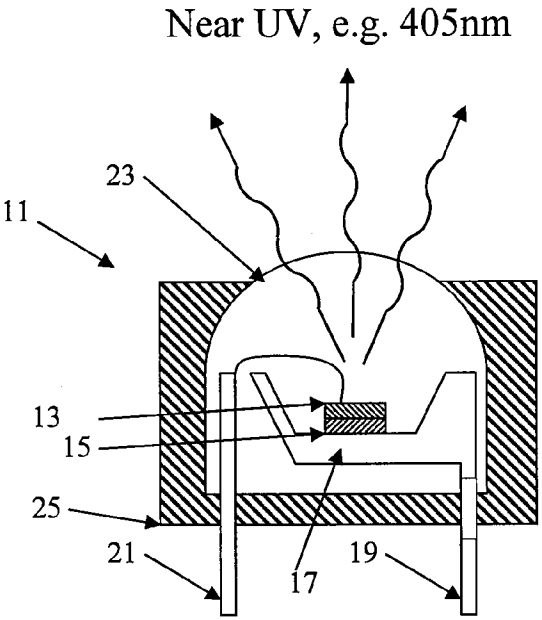
FIG. 2 is a simplified cross-sectional view of a light-emitting diode (LED) type solid state source, which may be used as the source in a tunable white lighting device.

To provide readers a full understanding, it may help to consider a simplified example of the structure of a solid state source 11, such as a near UV LED type solid state source. FIG. 2 illustrates a simple example of a near UV LED type solid state source 11, in cross section. In the example of FIG. 2, the source 11 includes at least one semiconductor chip, each comprising two or more semiconductor layers 13, 15 forming the actual LED. The semiconductor layers 13, 15 of the chip are mounted on an internal reflective cup 17, formed as an extension of a first electrode, e.g. the cathode 19. The cathode 19 and an anode 21 provide electrical connections to layers of the semiconductor chip device within the packaging for the source 11. In the example, an epoxy dome 23 (or similar transmissive part) of the enclosure allows for emission of the electromagnetic energy from the chip in the desired direction.

In this simple example, the solid state source 11 also includes a housing 25 that completes the packaging/enclosure for the source. Typically, the housing 25 is metal, e.g. to provide good heat conductivity so as to facilitate dissipation of heat generated during operation of the LED. Internal "micro" reflectors, such as the reflective cup 17, direct energy in the desired direction and reduce internal losses. Although one or more elements in the package, such as the reflector 17 or dome 23 may be doped or coated with phosphor materials, phosphor doping integrated in (on or within) the package is not required for remote phosphor or remote semiconductor nanophosphor implementations as discussed herein. The point here at this stage of our discussion is that the solid state source 11 is rated to emit near UV electromagnetic energy of a wavelength in the 380-420 nm range, such as 405 nm in the illustrated example.

Semiconductor devices such as the solid state source 11 exhibit emission spectra having a relatively narrow peak at a predominant wavelength, although some such devices may have a number of peaks in their emission spectra. Often, manufacturers rate such devices with respect to the intended wavelength of the predominant peak, although there is some variation or tolerance around the rated value, from device to device. For example, the solid state source 11 in the example of FIGS. 1A-1D and 2 is rated for a 405 nm output, which means that it has a predominant peak in its emission spectra at or about 405 nm (within the manufacturer's tolerance range of that rated wavelength value). However, other devices that have additional peaks in their emission spectra can be used in the examples described herein.

The structural configuration of the solid state source 11 shown in FIG. 2 is presented here by way of example only. Those skilled in the art will appreciate that any solid state light emitting device can be used, and the present teachings are not limited to near UV LEDs. Blue LEDs may also be used, and LEDs or the like producing other colors of visible light may be used if the phosphors selected for a particular implementation absorb light of those colors. In the example of FIG. 2, the LED device is configured as a source of 380-420 nm near UV range electromagnetic energy, for example, having substantial energy emissions in that range such as a predominant peak at or about 405 nm.

Returning to FIG. 1A, the tunable white light emitting device 10 allows for the changing of intensity of emission of visible light by one of more phosphors contained in each light guide 12. Changing the intensity of energy that the respective sources supply to the different light guides 12 changes the respective pumping energy supplied to the phosphors contained in the light guides, which in turn changes the levels of excitation and thus changes the respective intensities of the emissions of the excited phosphors. The color or spectrum of energy of the emissions from the solid state source 11 for every light guide is essentially the same (same rating although there may be variations with manufacturers' tolerances), but the phosphor(s) contained in each light guide are different, from one light guide to the next. The changing of intensity of the phosphor will now be described with reference to FIG. 3.

Figure 3:
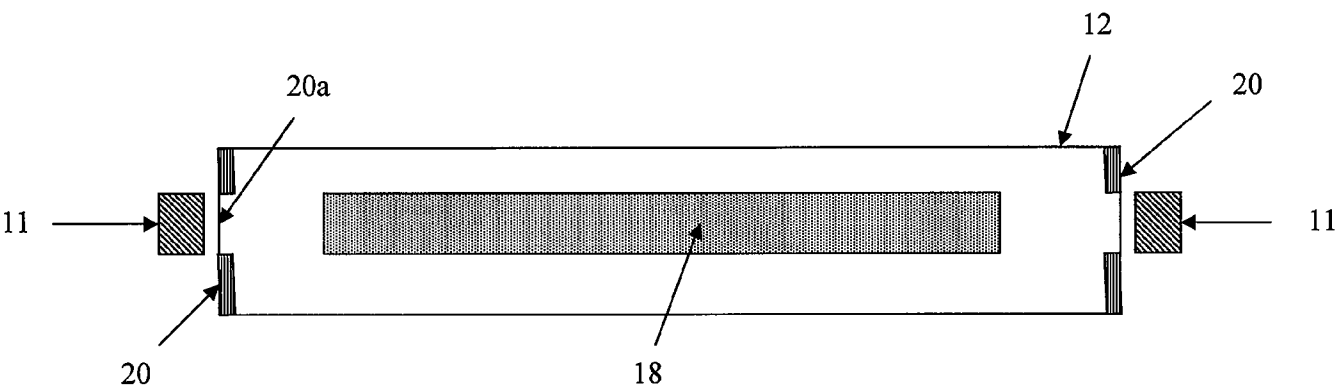
FIG. 3 is cross-sectional view of one light guide/container included in the tunable white light emitting device of FIG. 1A.

FIG. 3 shows one of the light guide/phosphor containing optical elements of the tunable white light emitting device 10. In the example of FIG. 3, two solid state sources 11 are optically coupled to the ends of light guide 12, although in this case, not via direct contact or index matched coupling. The end surfaces 20 of the light guide are specular surfaces facing back inside the light guide 12. End surfaces 20*a* positioned between specular surfaces 20 are made of glass or acrylic and allow light emitted from the solid state sources 11 to pass into the light guide 12. The light guide 12 is formed of a light transmissive material having an index of refraction that is higher than that of the ambient environment, typically air. The element 12 is configured so that most light from the sources passes axially through the element or at most is directed toward a side of the element 12 at a relatively shallow angle with respect to the sidewall of the element. As a result, total internal reflection (TIR) from the side surface(s) can be realized with the positioning of the solid state sources in the opening between specular surfaces 20. Hence, electromagnetic energy of the first emission spectrum from the sources 11 will pass and reflect back and forth within the element 12, but relatively little of that energy will emerge through the sidewall(s) of the optical element. Stated another way, the optical element 12 is configured and coupled to each source 11 so as to receive energy from the source and act as a light guide with respect to the energy received from the source.

In the examples of FIGS. 1A-1D and 3, the light guides 12 are tubular. Those skilled in the art will recognize that the tubular light guides may be made of a variety of materials/structures having the desired optical properties. For example, each light guide 12 could be made from a 3M™ Light Pipe, which is filled with a phosphor bearing material 18 and appropriately sealed at both ends. The ends sealing the tube would have the reflective coating 20 and the transmissive section 20*a*, like those of FIG. 3. As manufactured by 3M™, a Light Pipe is a transparent tube lined with 3M™ Optical Lighting Film, which is a micro-replicated prismatic film. The film is transmissive with respect to light striking the surface of the film at steep angles, but it is highly reflective to light striking the surface of the film at shallow angles. In a lightguide 12 implemented using the 3M™ a Light Pipe, light emitted by the LEDs 11 which strikes the film reflects back into the interior of the light guide and tends to travel along the length of the light guide 12. If not absorbed by a phosphor particle in the material 18 contained within the light guide 12, the light may reflect back from the reflector 20*a* on the opposite tube end and travel the length of the light guide again, with one or more reflections off the film lining the interior tube surface. However, light generated by phosphor excitations within the light guide 12 impacts the film at steeper angles, and the film allows relatively uniform release along the length of the light guide 12.

A variety of conventional phosphors may be contained in the light guides 12 in the form of a solid, liquid or gas. Recently developed quantum dot (Q-dot) phosphors or doped quantum dot (D-dot) phosphors may be used. Phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Quantum dots (Q-dots) provide similar shifts in wavelengths of light. Quantum dots are nano scale semiconductor particles, typically crystalline in nature, which absorb light of one wavelength and re-emit light at a different wavelength, much like conventional phosphors. However, unlike conventional phosphors, optical properties of the quantum dots can be more easily tailored, for example, as a function of the size of the dots. In this way, for example, it is possible to adjust the absorption spectrum and/or the emission spectrum of the quantum dots by controlling crystal formation during the manufacturing process so as to change the size of the quantum dots. Thus, quantum dots of the same material, but with different sizes, can absorb and/or emit light of different colors. For at least some exemplary quantum dot materials, the larger the dots, the redder the spectrum of re-emitted light; whereas smaller dots produce a bluer spectrum of re-emitted light. Doped quantum dot (D-dot) phosphors are similar to quantum dots but are also doped in a manner similar to doping of a semiconductor. Also, Colloidal Q-Dots are commercially available from NN Labs of Fayetteville, Ark. and are based upon cadmium selenide. Doped semiconductor nanophosphors are commercially available from NN Labs of Fayetteville, Ark. and are based upon manganese or copper-doped zinc selenide and can be used with near UV solid state emitters (e.g. LEDs).

The phosphors may be provided in the form of an ink or paint. In FIG. 3, the one or more phosphors 18 are included within the light guide 12. The phosphor 18 is positioned between the solid state emitters 11 within the light guide 12. The phosphor material 18 can be a solid, liquid or gas contained within the light guide 12, for example, in the form of a bearer material in an internal volume of the container/light-guide with the respective phosphor dispersed in that material. The medium preferably is highly transparent (high transmissivity and/or low absorption to light of the relevant wavelengths). Although alcohol, vegetable oil or other media may be used, the medium or bearer material may be a silicon material. If silicone is used, it may be in gel form or cured into a hardened form in the finished lighting fixture product. Another example of a suitable material, having D-dot type phosphors in a silicone medium, is available from NN Labs of Fayetteville, Ark. A Q-Dot product, applicable as an ink or paint, is available from QD Vision of Watertown Mass.

In the present tunable white light example, the device 10 produces white light of desirable characteristics using a number of semiconductor nanophosphors, and further discussion of the examples including that of FIG. 1A will concentrate on such white light implementations.

Hence for further discussion of this example, we will assume that the each light guide 12 forms a container filled with a gaseous or liquid material bearing a different one or more semiconductor nanophosphor dispersed therein. Also, for further discussion, we will assume that the solid state source 11 is a near UV emitting LED, such as a 405 nm LED or other type of LED rated to emit somewhere in the wavelength range of 380-420 nm. Although other types of semiconductor nanophosphors are contemplated, we will also assume that each nanophosphor is a doped semiconductor of a type excited in response to at least the near UV electromagnetic energy from the LED or LEDs 11 forming the solid state source.

When so excited, each doped semiconductor nanophosphor in the tunable white light device 10 re-emits visible light of a different spectrum. However, each such emission spectrum has substantially no overlap with absorption spectra of the doped semiconductor nanophosphors. As will be discussed more later, the emission spectra are relatively broad, as compared to relatively pure or monochromatic light, such as the narrow spectrum emissions from the LEDs 11. For example, the emission spectra of the phosphors in the tunable white light device 10 are broader than the emission spectrum of the LEDs 11. When excited by the electromagnetic energy received from the LEDs 11, the doped semiconductor nanophosphors together produce visible light output for the light fixture of a desired characteristic, through the exterior surface (s) of the container 12.

In a white light type example of the device 10, the excited nanophosphors together produce output light that is at least substantially white in that it appears as visible white light to a human observer, although it may not be truly white in the electromagnetic sense. For at least one set of respective intensities of the electromagnetic energy emitted by the solid state sources 11, and possible a number of such settings, the relative levels of excitations of the first and second phosphors produce visible white light output of the lighting system corresponding to a point on the black body curve. At such settings, the white light output has a color rendering index (CRI) of 75 or higher.

In such a configuration, the tunable lighting device 10 can selectively output light produced by this excitation of the semiconductor nanophosphors which exhibits color temperature in one and possible several selected ones of a number desired ranges along the black body curve that are particularly useful in general lighting application. When adjusted, the white output light of the device 10 exhibits color temperature in at least one of four specific ranges along the black body curve listed in Table 1 below and may be able to change from one such range to another in response to changes of the drive currents applied to the LED type sources 11.

TABLE 1

Nominal Color Temperatures and Corresponding Color Temperature Ranges

| Nominal Color Temp. (° Kelvin) | Color Temp. Range (° Kelvin) |
|---|---|
| 2700 | 2725 ± 145 |
| 3000 | 3045 ± 175 |
| 3500 | 3465 ± 245 |
| 4000 | 3985 ± 275 |

Figure 4:
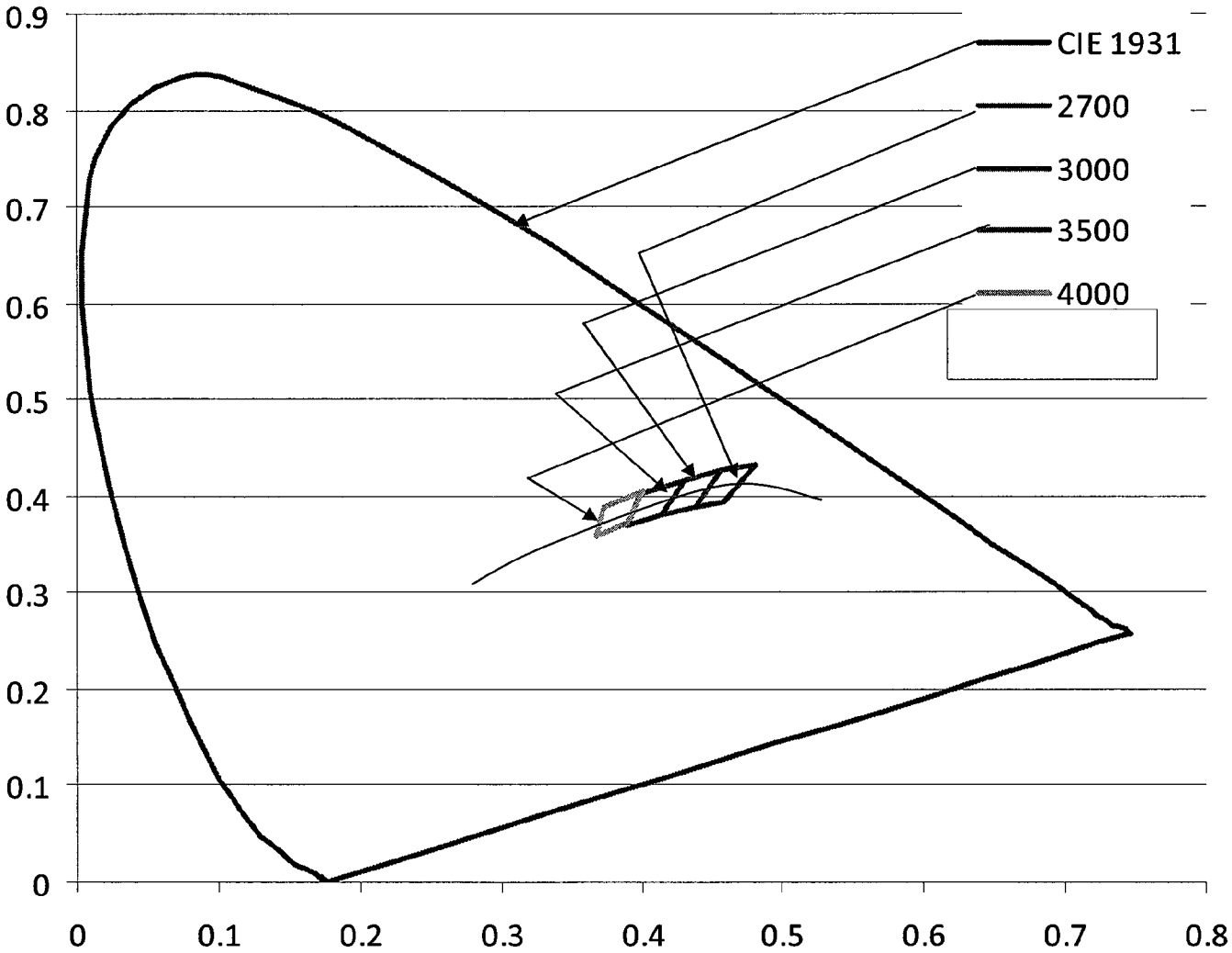
FIG. 4 is a color chart showing the black body curve and tolerance quadrangles along that curve for chromaticities corresponding to desired color temperature ranges for points along the black body curve.

In Table 1, the nominal color temperature values represent the rated or advertised temperature as would apply to a particular tunable white light emitting system products having an output color temperature within the corresponding ranges. The color temperature ranges fall along the black body curve. FIG. 4 shows the outline of the CIE 1931 color chart, and the curve across a portion of the chart represents a section of the black body curve that includes the desired CIE color temperature (CCT) ranges. Although intensities are set to correspond to a desired temperature/point along the black body curve, the light may also vary somewhat in terms of chromaticity from the coordinates on the black body curve. The quadrangles shown in the drawing represent the range of chromaticity for each nominal CCT value. Each quadrangle is defined by the range of CCT and the distance from the black body curve.

Table 2 below provides a chromaticity specification for each of the four color temperature ranges. The x, y coordinates define the center points on the black body curve and the vertices of the tolerance quadrangles diagrammatically illustrated in the color chart of FIG. 4. The region covered by a quadrangle is an example of a range of output light characteristics that would still correspond to a particular point or temperature along the black body curve.

TABLE 2

Chromaticity Specification for the Four Nominal Values/CCT Ranges

| | CCT Range | | | | | | | |
|---|---|---|---|---|---|---|---|---|
| | 2725 ± 145 | | 3045 ± 175 | | 3465 ± 245 | | 3985 ± 275 | |
| | Nominal CCT | | | | | | | |
| | 2700° K | | 3000° K | | 3500° K | | 4000° K | |
| | x | y | x | y | x | y | x | y |
| Center point | 0.4578 | 0.4101 | 0.4338 | 0.4030 | 0.4073 | 0.3917 | 0.3818 | 0.3797 |
| | 0.4813 | 0.4319 | 0.4562 | 0.4260 | 0.4299 | 0.4165 | 0.4006 | 0.4044 |
| Tolerance | 0.4562 | 0.426 | 0.4299 | 0.4165 | 0.3996 | 0.4015 | 0.3736 | 0.3874 |
| Quadrangle | 0.4373 | 0.3893 | 0.4147 | 0.3814 | 0.3889 | 0.369 | 0.367 | 0.3578 |
| | 0.4593 | 0.3944 | 0.4373 | 0.3893 | 0.4147 | 0.3814 | 0.3898 | 0.3716 |

Figure 5:
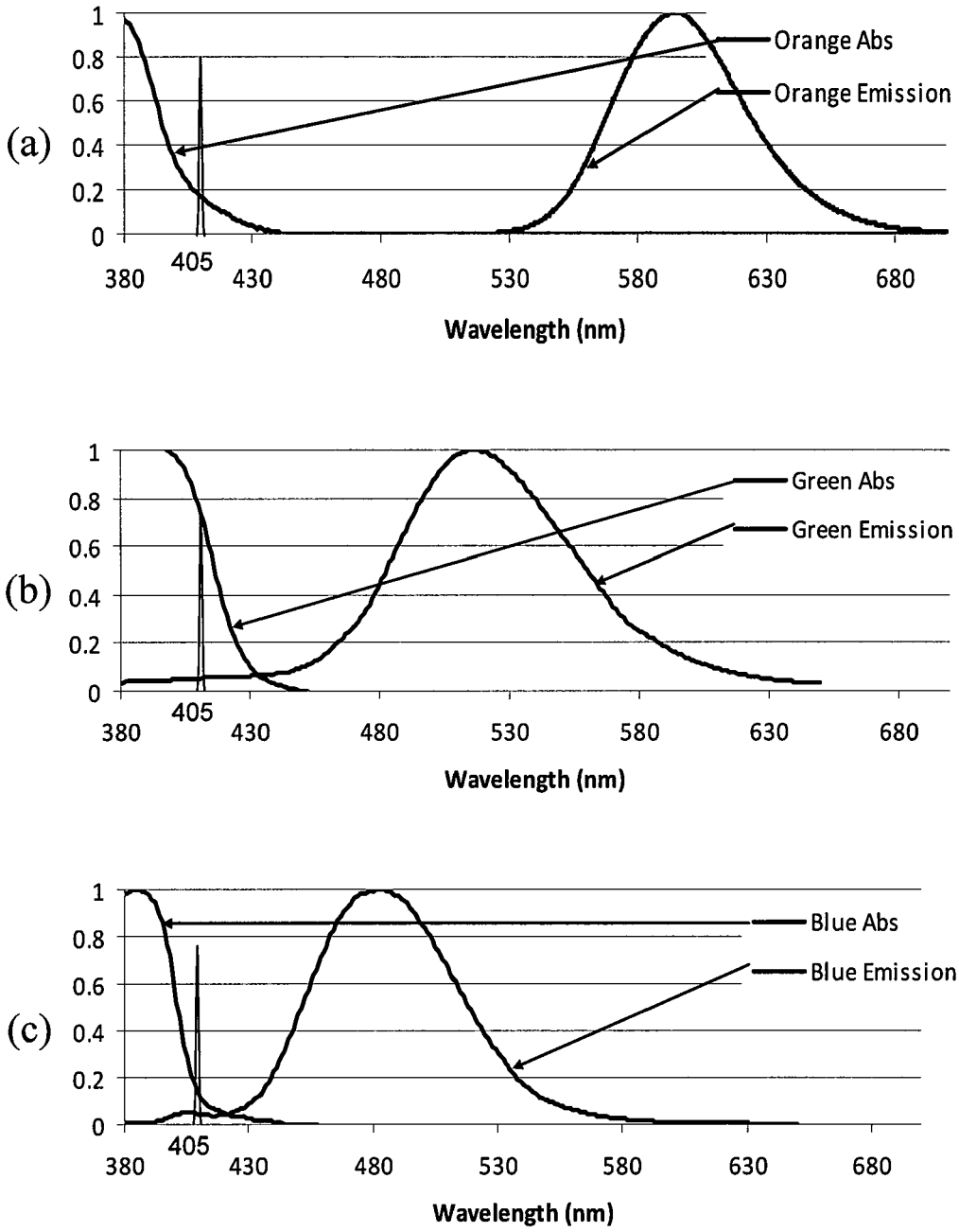
FIG. 5 is a graph of absorption and emission spectra of a number of doped semiconductor nanophosphors.

Doped semiconductor nanophosphors exhibit a large Stokes shift, that is to say from a short-wavelength range of absorbed energy up to a fairly well separated longer-wavelength range of emitted light. FIG. 5 shows the absorption spectra, as well as the emission spectra, of three examples of doped semiconductor nanophosphors. Each line of the graph also includes an approximation of the emission spectra of the 405 nm LED chip, to help illustrate the relationship of the 405 nm LED emissions to the absorption spectra of the exemplary doped semiconductor nanophosphors. As can be seen, the emission spectra of these exemplary phosphors are relatively broad, for example, broader than the relatively pure emission spectrum of the LED sources 11. The broad emission spectra tend to represent light colors that may appear pastel to a human observer as opposed to a more pure or even monochromatic spectrum that appears to have a high degree of saturation to a human observer. The excitation spectra of the phosphors overlap or encompass the main lobe including the peak of the LED emission spectrum. The illustrated spectra are not drawn precisely to scale, but in a manner to provide a teaching example to illuminate our discussion here.

The top line (a) of the graph shows the absorption and emission spectra for an orange emitting doped semiconductor nanophosphor. The absorption spectrum for this first phosphor includes the 380-420 nm near UV range, but that excitation spectrum drops substantially to 0 (has an upper limit) somewhere around or a bit below 450 nm. As noted, the phosphor exhibits a large Stokes shift from the short wavelength(s) of absorbed light to the longer wavelengths of re-emitted light. The emission spectrum of this first phosphor has a fairly broad peak in the wavelength region humans perceive as orange. Of note, the emission spectrum of this first phosphor is well above the illustrated absorption spectra of the other doped semiconductor nanophosphors and well above its own absorption spectrum. As a result, orange emissions from the first doped semiconductor nanophosphor would not re-excite that phosphor and would not excite the other doped semiconductor nanophosphors if used together in two or more light guides of a device 10 like those of FIGS. 1A to 1D. Stated another way, the orange phosphor emissions would be subject to little or no phosphor re-absorption, even in devices containing one or more of the other doped semiconductor nanophosphors.

The next line (b) of the graph in FIG. 5 shows the absorption and emission spectra for a green emitting doped semiconductor nanophosphor. The absorption spectrum for this second phosphor includes the 380-420 nm near UV range, but that excitation spectrum drops substantially to 0 (has an upper limit) about 450 or 460 nm. This phosphor also exhibits a large Stokes shift from the short wavelength(s) of absorbed light to the longer wavelengths of re-emitted light. The emission spectrum of this second phosphor has a broad peak in the wavelength region humans perceive as green. Again, the emission spectrum of the phosphor is well above the illustrated absorption spectra of the other doped semiconductor nanophosphors and well above its own absorption spectrum. As a result, green emissions from the second doped semiconductor nanophosphor would not re-excite that phosphor and would not excite the other doped semiconductor nanophosphors if used together in two or more light guides of a device 10 like those of FIGS. 1A to 1D. Stated another way, the green phosphor emissions would be subject to little or no phosphor re-absorption, even in devices containing one or more of the other doped semiconductor nanophosphors.

The bottom line (c) of the graph shows the absorption and emission spectra for a blue emitting doped semiconductor nanophosphor. The absorption spectrum for this third phosphor includes the 380-420 nm near UV range, but that excitation spectrum drops substantially to 0 (has an upper limit) about 450 or 460 nm. This phosphor also exhibits a large Stokes shift from the short wavelength(s) of absorbed light to the longer wavelengths of re-emitted light. The emission spectrum of this third phosphor has a broad peak in the wavelength region humans perceive as blue. The main peak of the emission spectrum of the phosphor is well above the illustrated absorption spectra of the other doped semiconductor nanophosphors and well above its own absorption spectrum. In the case of the blue example, there is just a small amount of emissions in the region of the phosphor absorption spectra. As a result, blue emissions from the third doped semiconductor nanophosphor would re-excite that phosphor at most a minimal amount. As in the other phosphor examples of FIG. 5, the blue phosphor emissions would be subject to relatively little phosphor re-absorption, even if used together in two or more light guides of a device 10 like those of FIGS. 1A to 1D with one or more of the other doped semiconductor nanophosphors.

Examples of suitable orange, green and blue emitting doped semiconductor nanophosphors of the types generally described above relative to FIG. 5 are available from NN Labs of Fayetteville, Ark.

As explained above, the large Stokes shift results in negligible re-absorption of the visible light emitted by doped semiconductor nanophosphors. This allows the stacking of multiple phosphors in various light guides or other forms of optically separate deployment elements. It becomes practical to select and choose two, three or more such phosphors for deployment in the various light guide type optical elements 12 in a manner that produces a particular desired spectral characteristic in the combined light output generated by the phosphor emissions, which may then be tuned or adjusted by controlling the drive of the sources 11 and thus the levels of the respective amounts of light emissions from the various excited nanophosphors from the different optical elements 12 in the visible light output of the device 10.

Figure 6A:
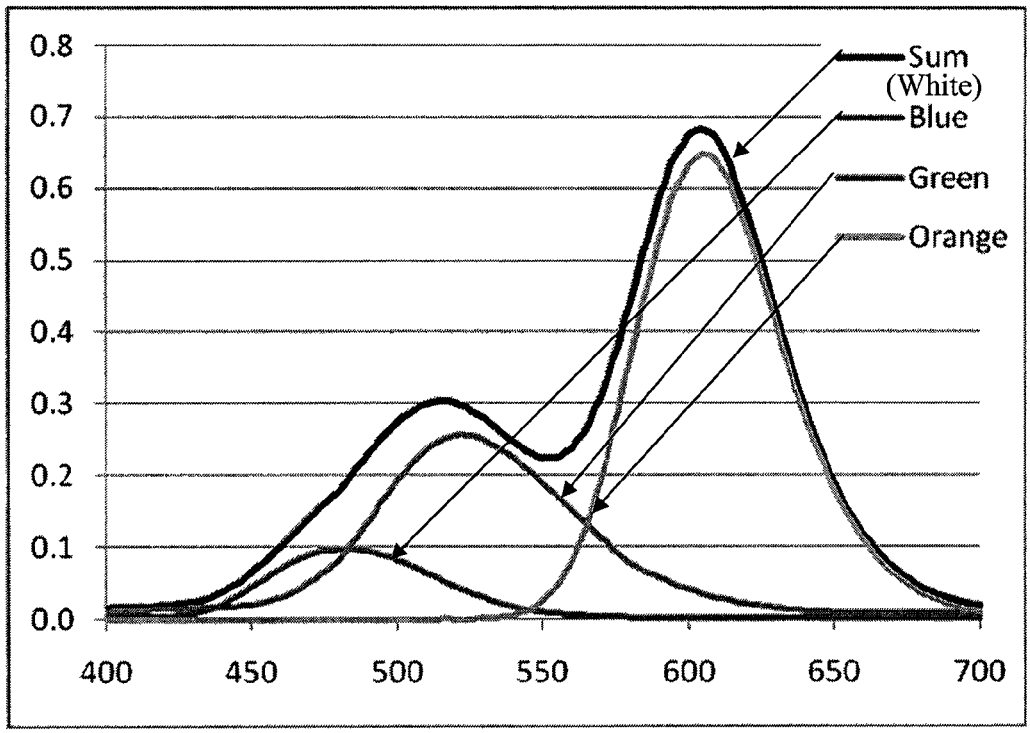
FIG. 6A is a graph of emission spectra of three doped semiconductor nanophosphors selected for use in an exemplary tunable white light emitting device as well as the spectrum of the white light produced by combining the spectral emissions from those three phosphors.

FIG. 6A graphically depicts emission spectra of three of the doped semiconductor nanophosphors selected for use in an exemplary solid state lighting device as well as the spectrum of the white light produced by summing or combining the spectral emissions from those three phosphors, for an exemplary set of respective intensities of the electromagnetic energy emitted by three of the solid state sources 11, where the relative levels of excitations of the first and second phosphors produce visible white light output of the solid state lighting device corresponding to a point on the black body curve. For convenience, the emission spectrum of the LED has been omitted from FIG. 6A, on the assumption that a high percentage of the 405 nm light from the LED is absorbed by the phosphors. Although the actual output emissions from the device may include some near UV light from the LED, the contribution thereof if any to the sum in the output spectrum should be relatively small.

Although other combinations are possible based on the phosphors discussed above relative to FIG. 5 or based on other semiconductor nanophosphor materials, the example of FIG. 6A represents emissions of blue, green and orange phosphors, for one set of intensity levels from the LEDs which supply excitation energy to the various phosphors. The emission spectra of the blue, green and orange emitting doped semiconductor nanophosphors are similar to those of the corresponding color emissions shown in FIG. 5.

As an example, the tunable white light emitting device 10 of FIG. 1C (containing three light guides 12 and driven by near UV sources 11) includes the blue, green and orange emitting doped semiconductor nanophosphors, the addition of the blue, green and orange emissions for the particular set of excitation intensities produces a combined spectrum as approximated by the top or 'Sum' curve in the graph of FIG. 5A.

The CIE color rendering index or "CRI" is a standardized measure of the ability of a light source to reproduce the colors of various objects, based on illumination of standard color targets by a source under test for comparison to illumination of such targets by a reference source. CRI, for example, is currently used as a metric to measure the color quality of white light sources for general lighting applications. Presently, CRI is the only accepted metric for assessing the color rendering performance of light sources. However, it has been recognized that the CRI has drawbacks that limit usefulness in assessing the color quality of light sources, particularly for LED based lighting products. NIST has recently been working on a Color Quality Scale (CQS) as an improved standardized metric for rating the ability of a light source to reproduce the colors of various objects. The color quality of the white light produced by the systems discussed herein is specified in terms of CRI, as that is the currently available/accepted metric. Those skilled in the art will recognize, however, that the systems may be rated in future by corresponding high measures of the quality of the white light outputs using appropriate values on the CQS once that scale is accepted as an appropriate industry standard. Of course, other even more accurate metrics for white light quality measurement may be developed in future.

It is possible to add one or more additional nanophosphors, e.g. a fourth, fifth, etc., to in respective additional light guides to further improve the CRI and/or allow further tuning of the spectral or color characteristic of the visible white light output of the lighting device 10. For example, to improve the CRI of the nanophosphor combination of FIGS. 5 and 6A, a doped semiconductor nanophosphor might be added to the combination with a broad emissions spectrum that is yellowish-green or greenish-yellow, that is to say with a peak of the phosphor emissions somewhere in the range of 540-570 nm, say at 555 nm. The fourth phosphor would be contained in a fourth light guide element (see FIG. 1D) and pumped by excitation energy emitted by at a controllable level by a fourth solid state source.

Other combinations also are possible, with two, three or more phosphors, such as but not limited to, doped semiconductor nanophosphors. The example of FIG. 6B uses red, green and blue emitting semiconductor nanophosphors, as well as a yellow fourth doped semiconductor nanophosphor. Although not shown, the excitation or absorption spectra would be similar to those of the three nanophosphors discussed above relative to FIG. 5. For example, each absorption spectrum would include at least a portion of the 380-420 nm near UV range. All four phosphors would exhibit a large Stokes shift from the short wavelength(s) of absorbed light to the longer wavelengths of re-emitted light, and thus their emissions spectra have little or no overlap with the absorption spectra.

In this example (FIG. 6B), the blue nanophosphor exhibits an emission peak at or around 484, nm, the green nanophosphor exhibits an emission peak at or around 516 nm, the yellow nanophosphor exhibits an emission peak at or around 580, and the red nanophosphor exhibits an emission peak at or around 610 nm. For a given set of controlled intensity levels, for the emissions from the four LED based solid state sources, the addition of these blue, green, red and yellow phosphor emissions produces a combined spectrum as approximated by the top or 'Sum' curve in the graph of FIG. 6B. The 'Sum' curve in the graph represents a resultant white light output having a color temperature of 2600° Kelvin (within the 2,725±145° Kelvin range), where that white output light also would have a CRI of 88 (higher than 75). However, control of the respective excitations of the respective phosphors, and thus the relative phosphor emission levels, enables tuning of the color temperature from a rated temperature as or when desired.

Various combinations of phosphors in the light guides including, but not limited to combinations of doped semiconductor nanophosphors, will produce white light emissions from tunable white light emitting systems that exhibit CRI of 75 or higher. For an intended product specification, a particular combination of phosphors is chosen so that the light output of the device exhibits color temperature in at least one of the following specific ranges along the black body curve: 2,725±145° Kelvin; 3,045±175° Kelvin; 3,465±245° Kelvin; and 3,985±275° Kelvin. In the example shown in FIG. 6A, the 'Sum' curve in the graph produced by the mixture of blue, green and orange emitting doped semiconductor nanophosphors would result in a white light output having a color temperature of 2800° Kelvin (within the 2,725±145° Kelvin range). That white output light also would have a CRI of 80 (higher than 75). However, control of the respective emissions from the respective phosphors enables tuning of the color temperature from the rated temperature as or when desired, for example, to correspond to other points on or somewhat off of the black body curve.

Figure 6B:
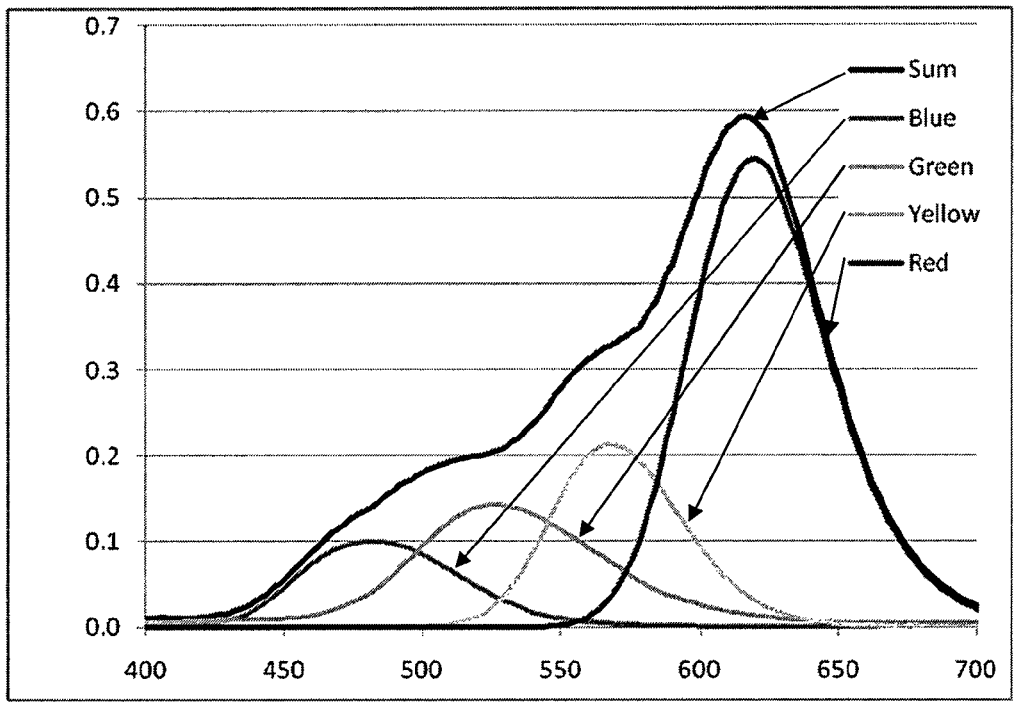
FIG. 6B is a graph of emission spectra of four doped semiconductor nanophosphors, in this case, for red, green, blue and yellow emissions, as well as the spectrum of the white light produced by combining the spectral emissions from those four phosphors.

As shown by the examples of FIGS. 5-6B, the emission spectra of the various phosphors are substantially broader than the relatively monochromatic emission spectra of the LEDs. As shown by the graphs in FIGS. 6A and 6B, the emission spectra of some of the phosphors overlap, although the emissions peaks are separate. Such spectra represent pastel colors of relatively low purity levels. However, when added together, these emission spectra tend to fill-in gaps somewhat, so that there may be peaks but not individual spikes in the spectrum of the resultant combined output light. Stated another way, the visible output light tends to be at least substantially white of a high quality when observed by a person. Although not precisely white in the electromagnetic sense, the light formed by combining or summing the emissions from the phosphors may approach a spectrum corresponding to that of a black body. Of the two examples, the 'sum' curve for the white light in the example of FIG. 6B comes closer to the spectrum of light corresponding to a point on the black body curve over a wavelength range from about 425 nm to about 630 nm, although the peak in the example somewhat exceeds the black body spectrum and the exemplary sum spectrum falls off somewhat faster after that peak.

Different settings for the LED outputs result in light corresponding to different points on the CIE color chart of FIG. 4. For example, turning one source up to pump one phosphor while turning the other sources down or off for little of no pumping of the other phosphors would result in a pastel color output corresponding to the rated color of the particular phosphor being pumped. For white light applications, the control logic might prevent such a setting and maintain intensities levels intended to result in relatively white output light. In the examples, tuning of the color characteristic of the white light output by adjustment of the respective intensities of the pumping energy supplied to the phosphors by the emissions from the different LED type solid state sources 11 allows for selection of white light of characteristic(s) corresponding to points along the black body curve, including in the four color temperature ranges discussed above relative to Tables 1 and 2. In addition to points on or about the black body curve (or corresponding to points on that curve), other settings may select substantially white light somewhat further off of that curve but which a person would still perceive as white.

Figure 7:
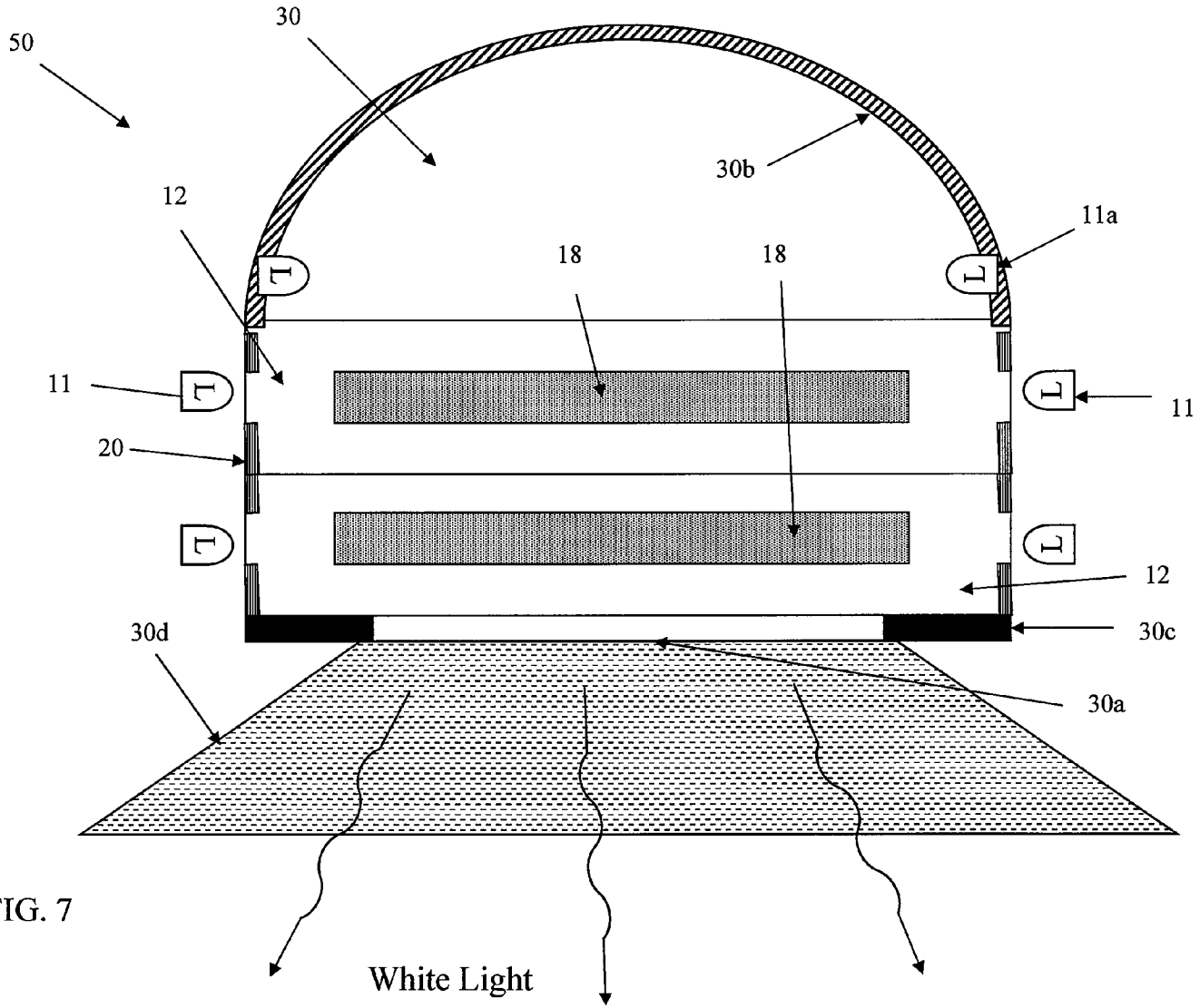
FIG. 7 illustrates another example of a tunable white light emitting device, with certain elements thereof shown in cross-section.
Figure 8:
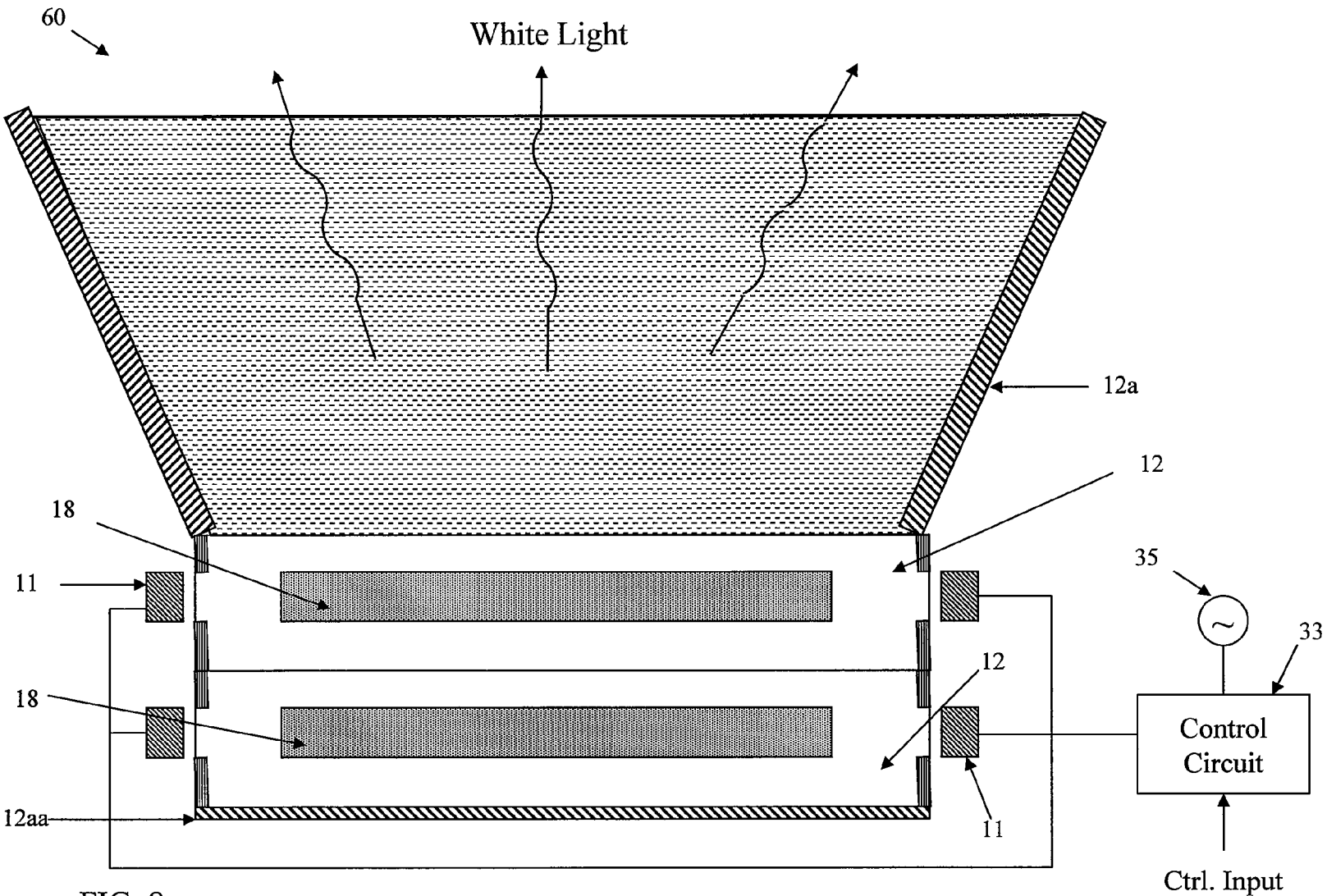
FIG. 8 is yet another example of a tunable white light emitting device, with certain elements thereof shown in cross-section, combined with a control circuit to form an overall light emitting system.

Alternative examples of tunable white light emitting devices and/or systems are shown in FIGS. 7 and 8.

In the example of FIG. 7, device 50 (without the electronics of the system) includes the solid state sources 11, which again for purposes of the example are rated to emit 405 nm near UV energy toward the light guides 12. The device is configured as a downlight type device similar to that in overall design of a traditional downlight fixture. The lighting device 50 uses a light transmissive solid in the optical integrating volume.

Energy from the sources impacts on and excites the phosphors 18 contained within the light guides 12. Although two light guides 12 are illustrated in FIG. 7, this example could use just one light guide 12 or could utilize more light guides 12. Some phosphor emissions from the light guides are diffusely reflected by the dome surface 30*b* back toward an optical aperture 30*a*. Much of the reflected 405 nm energy in turn impacts on the phosphors 18. When so excited, the phosphor particles re-emit electromagnetic energy but now of the wavelengths for the desired visible spectrum for the intended white light output. The visible light produced by the excitation of the phosphor particles diffusely reflects one or more times off of the reflective inner surface 30*b* of the dome forming cavity 30. This diffuse reflection within the cavity integrates the light produced by the phosphor excitation to form integrated light of the desired characteristics at the optical aperture 30*a* providing a substantially uniform output distribution of integrated light (e.g. substantially Lambertian). Solid state sources 11*a* can be provided facing towards cavity 30. Light emitted from solid state sources 11*a* passes through the light guide(s) 12 once to impact the phosphor contained within the light guide, whereas light from solid state sources 11 passes through the light guides 12 multiple times and impacts the phosphor multiple times.

The optical aperture 30*a* may serve as the light output of the device 50, directing optically integrated white light of the desired characteristics and relatively uniform intensity distribution to a desired area or region to be illuminated in accord with a particular general lighting application of the system. Some masking 30*c* exists between the edge of the aperture 30*a* and the outside of the guides 12. The optical cavity is formed by a combination of the reflective dome 30, the reflective ends (or sides if circular) of the guides 12 and the reflective surface of the mask 30*c*.

The optical cavity can be a solid that is light transmissive (transparent or translucent) of an appropriate material such as acrylic or glass. The optical cavity can also be a contained liquid. If a solid is used, the solid forms an integrating volume because it is bounded by reflective surfaces which form a substantial portion of the perimeter of the cavity volume.

Stated another way, the assembly forming the optical integrating volume in this example comprises the light transmissive solid, a reflector having a reflective interior surface 30*b*.

The optical integrating volume is a diffuse optical processing element used to convert a point source input, typically at an arbitrary point not visible from the outside, to a virtual source. At least a portion of the interior surface of the optical integrating volume exhibits a diffuse reflectivity. Hence, in the example, the surface 30*b* is has a diffuse type of reflectivity and highly reflective (90% or more and possibly 98% or higher). The optical integrating volume may have various shapes. The illustrated cross-section would be substantially the same if the cavity is hemispherical or if the cavity is semi-cylindrical with a lateral cross-section taken perpendicular to the longitudinal axis of the semi-cylinder. For purposes of the discussion, the optical integrating volume in the device 50 is assumed to be hemispherical or nearly hemispherical. Hence, the solid would be a hemispherical or nearly hemispherical solid, and the reflector would exhibit a slightly larger but concentric hemispherical or nearly hemispherical shape at least along its internal surface, although the hemisphere would be hollow but for the filling thereof by the solid. In practice, the reflector may be formed of a solid material or as a reflective layer on a solid substrate and the solid molded into the reflector. Parts of the light emission surface of the solid (lower flat surface in the illustrated orientation) are masked by the reflective surface 30*c*. At least some substantial portions of the interior facing reflective surfaces 30*c* are diffusely reflective and are highly reflective, so that the resulting optical integrating volume has a diffuse reflectivity and is highly reflective.

In this example, the optical integrating volume forms an integrating type optical cavity. The optical integrating volume has a transmissive optical passage or aperture 30*a*. Emission of reflected and diffused light from within the interior of the optical integrating volume into a region to facilitate a humanly perceptible general lighting application for the device 50.

For some applications, the device 50 includes an additional deflector or other optical processing element as a secondary optic, e.g. to distribute and/or limit the light output to a desired field of illumination. In the example of FIG. 7, the fixture part of the device 50 also utilizes a conical deflector 30*d* having a reflective inner surface, to efficiently direct most of the light emerging from the virtual light source at optical aperture 30*a* into a somewhat narrow field of illumination. The deflector 65 has a larger opening at a distal end thereof compared to the end adjacent to the optical aperture 30*a*. The angle and distal opening size of the conical deflector 30*d* define an angular field of white light emission from the device 50. Although not shown, the large opening of the deflector may be covered with a transparent plate, a diffuser or a lens, or covered with a grating, to prevent entry of dirt or debris through the cone into the system and/or to further process the output white light. Alternatively, the deflector could be filled with a solid light transmissive material of desirable properties.

The conical deflector 30*d* may have a variety of different shapes, depending on the particular lighting application. In the example, where the cavity 30 is hemispherical and the optical aperture 30*a* is circular, the cross-section of the conical deflector is typically circular. However, the deflector may be somewhat oval in shape. Even if the aperture 30*a* and the proximal opening are circular, the deflector may be contoured to have a rectangular or square distal opening. In applications using a semi-cylindrical cavity, the deflector may be elongated or even rectangular in cross-section. The shape of the optical aperture 30*a* also may vary, but will typically match the shape of the opening of the deflector 30*d*. Hence, in the example the optical aperture 30*a* would be circular. However, for a device with a semi-cylindrical cavity and a deflector with a rectangular cross-section, the optical aperture may be rectangular.

The deflector 30*d* comprises a reflective interior surface between the distal end and the proximal end. In some examples, at least a substantial portion of the reflective interior surface of the conical deflector exhibits specular reflectivity with respect to the integrated light energy. For some applications, it may be desirable to construct the deflector 30*d* so that at least some portions of the inner surface 69 exhibit diffuse reflectivity or exhibit a different degree of specular reflectivity (e.g. quasi-specular), so as to tailor the performance of the deflector 30*d* to the particular application. For other applications, it may also be desirable for the entire interior surface of the deflector 65 to have a diffuse reflective characteristic.

The lighting device 50 outputs white light produced by the solid state sources 11 excitation of the phosphor materials 18 and may be controlled to selectively exhibit one or more of the color temperatures in the desired ranges along the black body curve discussed above. The phosphors 18 can be doped semiconductor nanophosphors or other phosphors of the types discussed above. The tunable white lighting device 50 could use a variety of different combinations of phosphors to produce a desired output. Different lighting devices (or systems including such devices) designed for different color temperatures of white output light and/or different degrees of available tuning may use different combinations of phosphors such as different combinations of two, three, four or more of the doped semiconductor nanophosphors as discussed earlier. The white output light of the device 50 can exhibit a color temperature in one of the four ranges along the black body curve listed in Table 1 above and permit tuning thereof in a manner analogous to the tuning in the earlier examples.

The phosphors 18 in device 50 can include the blue, green and orange emitting doped semiconductor nanophosphors. The solid state sources 11 are rated to emit near UV electromagnetic energy of a wavelength in the 380-420 nm range, such as 405 nm in the illustrated example, which is within the excitation spectrum of the phosphors 18. When excited, that combination of the phosphors re-emits the various wavelengths of visible light represented by the blue, green and orange lines, such as in the graph of FIG. 6A. Combination or addition thereof in the fixture output produces "white" light, which for purposes of our discussion herein is light that is at least substantially white light.

The tunable white lighting device 50 may be coupled to a control circuit, to form a lighting system. Although not shown in FIG. 7 for convenience, such a controller would be coupled to the LED type semiconductor chip in each source 11, for establishing output intensity of electromagnetic energy of the respective LED sources 11. The control circuit may include one or more LED driver circuits for controlling the power applied to one or more sources 11 and thus the intensity of energy output of the source and thus of the system overall. The control circuit may be responsive to a number of different control input signals, for example to one or more user inputs, to turn power ON/OFF and/or to set a desired intensity level for the white light output provided by the device 50. However, the control circuit can also adjust the drives to the sources 11 to tune the color characteristic of the light output as in the earlier examples. The color tuning can be responsive to user input or can implement automatic control algorithms, e.g. to change the color temperature of the white light output for different times of day.

Turning now to system 60 in FIG. 8, another tunable white light emitting system is described. FIG. 8 is a simplified illustration of a tunable white light emitting system 60, for emitting visible, substantially white light, so as to be perceptible by a person. A fixture portion of the system is shown in cross-section (although some cross-hatching thereof has been omitted for ease of illustration). The circuit elements are shown in functional block form. The system 60 utilizes solid state sources 11, for emitting light energy, for example, of a wavelength in the near UV range, in this case in the 380-420 nm range.

The tunable white light system 60 includes a light guide configuration similar to that in FIG. 7. A reflector 12*aa* is positioned below the bottom guide 12 to reflect phosphor emissions aimed downward back up as part of the white light output shown at the top in the illustrated orientation. The lighting system could be configured for a general lighting application. Examples of general lighting applications include downlighting, task lighting, "wall wash" lighting, emergency egress lighting, as well as illumination of an object or person in a region or area intended to be occupied by one or more people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for task lighting to be effective. Of course, the system 60 of FIG. 8 may be used in other applications, such as vehicle headlamps, flashlights, etc.

System 60 has a reflector 12*a* with a reflective surface arranged to receive at least some pumped light from the phosphor material 18 from the light guides 12. If the phosphor material is housed, the material forming the walls of the housing exhibit high transmissivity and/or low absorption to light of the relevant wavelengths. The walls of the housing for the phosphor material 18 may be smooth and highly transparent or translucent, and/or one or more surfaces may have an etched or roughened texture.

The disclosed system 60 may use a variety of different structures or arrangements for the reflector 12*a*. For efficiency, the reflective surface of the reflector 12*a* should be highly reflective. The reflective surface may be specular, semi or quasi specular, or diffusely reflective. In the example, the emitting region of light guides 12 fits into or extends through an aperture in a proximal section of the reflector 12*a*. In the orientation illustrated, white light from the phosphor excitation, including any white light emissions reflected by the surface of reflector 12*a* are directed upwards, for example, for lighting a ceiling so as to indirectly illuminate a room or other habitable space below the fixture. The orientation shown, however, is purely illustrative.

The system 60 outputs white light produced by the solid state sources 11 excitation of the phosphor materials 18 and may be controlled to selectively exhibit one or more of the color temperatures in the desired ranges along the black body curve discussed above. The phosphors 18 can be doped semiconductor nanophosphors or other phosphors of the types discussed above. The tunable white light emission system 60 could use a variety of different combinations of phosphors to produce a desired output. Different lighting systems designed for different color temperatures of white output light and/or different degrees of available tuning may use different combinations of phosphors such as different combinations of two, three, four or more of the doped semiconductor nanophosphors as discussed earlier. The white output light of the system 60 can exhibit a color temperature in one of the four ranges along the black body curve listed in Table 1 above and permit tuning thereof in a manner analogous to the tuning in the earlier examples.

The phosphors 18 in system 60 can include the blue, green and orange emitting doped semiconductor nanophosphors. The solid state sources 11 are rated to emit near UV electromagnetic energy of a wavelength in the 380-420 nm range, such as 405 nm in the illustrated example, which is within the excitation spectrum of the phosphors 18. When excited, that combination of the phosphors re-emits the various wavelengths of visible light represented by the blue, green and orange lines, such as in the graph of FIG. 6A. Combination or addition thereof in the fixture output produces "white" light, which for purposes of our discussion herein is light that is at least substantially white light.

The tunable white light emission system 60 includes a control circuit 33 coupled to the LED type semiconductor chip in the source 11, for establishing output intensity of electromagnetic energy output of each of the LED sources 11. Similar control circuits could be used with the devices 10 and 50 in the earlier examples. The control circuit 33 typically includes a power supply circuit coupled to a voltage/current source, shown as an AC power source 35. Of course, batteries or other types of power sources may be used, and the control circuit 33 will provide the conversion of the source power to the voltage/current appropriate to the particular solid state sources utilized in a particular system. The control circuit 33 includes one or more LED driver circuits for controlling the power applied to one or more sources 11 and thus the intensity of energy output of the source and thus of the system overall. The control circuit 33 may be responsive to a number of different control input signals, for example to one or more user inputs as shown by the arrow in FIG. 8, to turn power ON/OFF and/or to set a desired intensity level for the white light output provided by the system 60. However, the control circuit can also adjust the drives to the sources 11 to tune the color characteristic of the light output as in the earlier examples. The color tuning can be responsive to user input or can implement automatic control algorithms, e.g. to change the color temperature of the white light output for different times of day.

Figure 9:
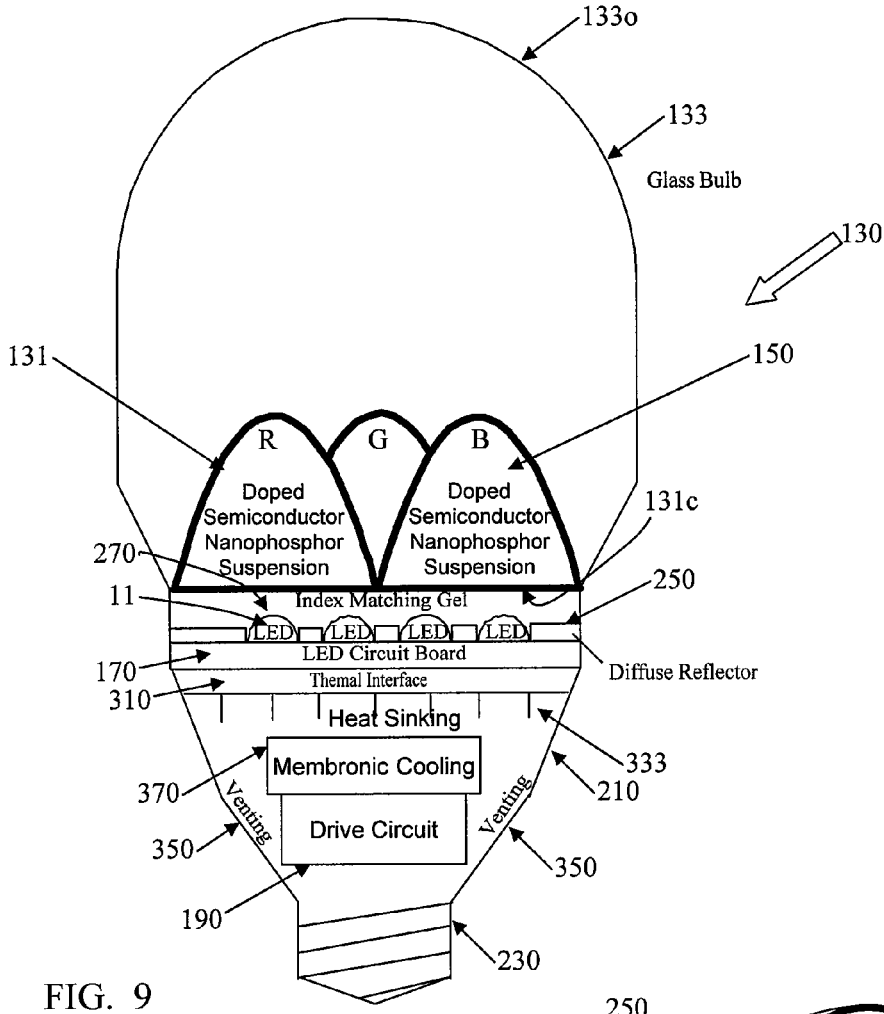
FIG. 9 a cross-sectional view of a tunable white light system, in the form of a lamp for lighting applications, which uses a solid state source and doped nanophosphors pumped by energy from the source to produce tunable white light.
Figure 10:
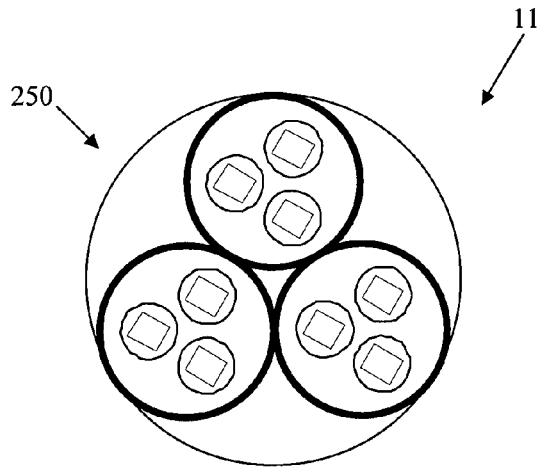
FIG. 10 is a plan view of the LEDs and reflector of the lamp of FIG. 9.

FIG. 9 illustrates yet another tunable white light emission system in cross section. Here, the system is in the form of a lamp product, in a form factor somewhat similar to a form factor of an incandescent lamp. The exemplary system 130 may be utilized in a variety of lighting applications. The solid state sources 11 are similar to those previously discussed. In the example, the sources comprise a plurality of light emitting diode (LED) devices, although other semiconductor devices might be used. Hence, in the example of FIG. 9, each of the three separately controllable sources 11 takes the form of a number of LEDs (e.g. three LEDs for each source as shown in the view of FIG. 10).

It is contemplated that the LEDs 11 could be of any type rated to emit energy of wavelengths from the blue/green region around 460 nm down into the UV range below 380 nm. The exemplary nanophosphors have absorption spectra having upper limits around 430 nm, although other phosphors may be used that have somewhat higher limits on the wavelength absorption spectra and therefore may be used with LEDs or other solid state devices rated for emitting wavelengths as high as say 460 nm. In the present example, the LEDs 11 are near UV LEDs rated for emission somewhere in the 380-420 nm range, such as the 405 nm LEDs discussed earlier, although UV LEDs could be used with the nanophosphors.

Two, three or more types of doped semiconductor nanophosphors are used in the system 130 to convert energy from the respective sources into visible light of appropriate spectra to produce a desired combined spectral characteristic of the visible light output of the lamp, tunable white light in the example. The doped semiconductor nanophosphors again are remotely deployed, in that they are outside of the individual device packages or housings of the LEDs 11. For this purpose, the exemplary system includes a number of optical elements in the form of phosphor containers formed of optically transmissive material coupled to receive near UV electromagnetic energy from the LEDs 11 forming the solid state source. Each container contains a material, which at least substantially fills the interior volume of the container. For example, if a liquid is used, there may be some gas in the container as well, although the gas should not include oxygen as oxygen tends to degrade the nanophosphors. The material may be a solid or a gas. In this example, the system includes at least one doped semiconductor nanophosphor dispersed in the material in each container.

As noted, the material may be a solid, although liquid or gaseous materials may help to improve the florescent emissions by the nanophosphors in the material. For example, alcohol, oils (synthetic, vegetable, silicon or other oils) or other liquid media may be used. A silicone material, however, may be cured to form a hardened material, at least along the exterior (to possibly serve as an integral container), or to form a solid throughout the intended volume. If hardened silicon is used, however, a glass container still may be used to provide an oxygen barrier to reduce nanophosphor degradation due to exposure to oxygen.

If a gas is used, the gaseous material, for example, may be hydrogen gas, any of the inert gases, and possibly some hydrocarbon based gases. Combinations of one or more such types of gases might be used.

Similar materials may be used, for example contained in the light guides, to remotely deploy the phosphors in the earlier examples.

In the illustrated example, three containers 131 are provided, each containing a phosphor bearing material 150. The three containers are enclosed by an outer bulb 133 which provides a desired output distribution and form factor, e.g. like a glass bulb of an A-lamp incandescent. The glass bulb 133 encloses three optical elements having the different nanophosphors as in the earlier examples. The elements 131 could be light guides as in the earlier examples but with pumping light entry from only one end and a transmissive or reflective opposite end. In the example, however, each of the three optical elements is a container 131. The container wall(s) are transmissive with respect to at least a substantial portion of the visible light spectrum. For example, the glass of each container 131 will be thick enough to provide ample strength to contain a liquid or gas material if used to bear the doped semiconductor nanophosphors in suspension, as shown at 150. However, the material of the container 131 will allow transmissive entry of energy from the LEDs 11 to reach the nanophosphors in the material 150 and will allow transmissive output of visible light principally from the excited nanophosphors.

Each glass element/container 131 receives energy from the LEDs 11 through a surface of the container, referred to here as an optical input coupling surface 131*c*. The example shows the surface 131*c* as a flat surface, although obviously other contours may be used. Light output from the system 130 emerges through one or more other surfaces of the containers 131 and through and outer surface of bulb 133, referred to here as output surface 133*o*. In the example, the bulb 133 here is glass, although other appropriate transmissive materials may be used. For a diffuse outward appearance of the bulb, the output surface(s) 133*o* may be frosted white or translucent. Alternatively, the output surface 133*o* may be transparent. The emission surfaces of the containers 131 may be may be frosted white or translucent, although the optical input coupling surfaces 131*c* might still be transparent to reduce reflection of energy from the LEDs 11 back towards the LEDs.

Although a solid could be used, in this example, each container 131 is at least substantially filled with a liquid or gaseous material 150 bearing a different doped semiconductor nanophosphor dispersed in the liquid or gaseous material 150. The example shows three containers 131 containing material 150 bearing nanophosphors for red (R), green (G) and blue (B) emissions, as in several of the earlier light guide examples. Also, for further discussion, we will assume that the LEDs 11 are near UV emitting LEDs, such as 405 nm LEDs or other types of LEDs rated to emit somewhere in the wavelength range of 380-420 nm, as in several earlier examples. Each of the doped semiconductor nanophosphors (Red, Green, and Blue) is of a type excited in response to near UV electromagnetic energy from the LEDs 11 of the solid state source. When so excited, each doped semiconductor nanophosphor re-emits visible light of a different spectrum. However, each such emission spectrum has substantially no overlap with excitation spectra of the doped semiconductor nanophosphors. When excited by the electromagnetic energy received from the LEDs 11, the doped semiconductor nanophosphors in material 150 in the three containers 131 together produce visible light output for the system 130 through the exterior surface(s) of the glass bulb 133.

The liquid or gaseous material 150 with the doped semiconductor nanophosphors dispersed therein appears at least substantially clear when the system 130 is off. For example, alcohol, oils (synthetic, vegetable or other oils) or other clear liquid media may be used, or the liquid material may be a relatively clear hydrocarbon based compound or the like. Exemplary gases include hydrogen gas, clear inert gases and clear hydrocarbon based gases. The doped semiconductor nanophosphors in the specific examples described below absorb energy in the near UV and UV ranges. The upper limits of the absorption spectra of the exemplary nanophosphors are all at or around 430 nm, however, the exemplary nanophosphors are relatively insensitive to other ranges of visible light often found in natural or other ambient white visible light. Hence, when the system 130 is off, the doped semiconductor nanophosphors exhibit little or no light emissions that might otherwise be perceived as color by a human observer. Even though not emitting, the particles of the doped semiconductor nanophosphors may have some color, but due to their small size and dispersion in the material, the overall effect is that the material 150 appears at least substantially clear to the human observer, that is to say it has little or no perceptible tint.

The LEDs 11 are mounted on a circuit board 17. The exemplary system 130 also includes circuitry 190. Although drive from DC sources is contemplated for use in existing DC lighting systems, the examples discussed in detail utilize circuitry configured for driving the LEDs 11 in response to alternating current electricity, such as from the typical AC main lines. The circuitry may be on the same board 170 as the LEDs or disposed separately within the system and electrically connected to the LEDs 11. Electrical connections of the circuitry 190 to the LEDs and the lamp base are omitted here for simplicity. Details of an example of drive circuitry are discussed later with regard to FIG. 11. However, as in the earlier examples, independent control of the drive to the three sets of LEDs that separately pump the three different nanophosphors in the containers 131 allows control of the mix of phosphor produced R, G and B light, to effectively tune the color of the white light output.

A housing 210 at least encloses the circuitry 190. In the example, the housing 210 together with a base 230 and a face of the glass bulb 133 also enclose the LEDs 11. The system 130 has a lighting industry standard base 230 mechanically connected to the housing and electrically connected to provide alternating current electricity to the circuitry 190 for driving the LEDs 11.

The base 230 may be any common standard type of lamp base, to permit use of the system 130 in a particular type of electrical socket. Common examples include an Edison base, a mogul base, a candelabra base and a bi-pin base. The base 230 may have electrical connections for a single intensity setting or additional contacts in support of three-way intensity setting/dimming.

The exemplary system 130 of FIG. 9 may include one or more features intended to prompt optical efficiency. Hence, as illustrated, the system 130 includes a diffuse reflector 250. The circuit board 170 has a surface on which the LEDs 11 are mounted, so as to face toward the light receiving surface of the glass bulb 133 containing the nanophosphor bearing material 150. The reflector 250 covers parts of that surface of the circuit board 170 in one or more regions between the LEDs 11. FIG. 10 is a view of the LEDs 11 and the reflector 25. When excited, the nanophosphors in the material 150 emit light in many different directions, and at least some of that light would be directed back toward the LEDs 11 and the circuit board 170. The diffuse reflector 250 helps to redirect much of that light back through the glass bulb 133 for inclusion in the output light distribution. The system may use any number of LEDs 11 sufficient to provide a desired output intensity.

There may be some air gap between the emitter outputs of the LEDs 11 and the facing optical coupling surface 131*c* of the containers 131 (FIG. 9). However, to improve out-coupling of the energy from the LEDs 11 into the light transmissive glass of the containers 131, it may be helpful to provide an optical grease, glue or gel 270 between the surfaces 131*c* of the glass containers 131 and the optical outputs of the LEDs 11. This index matching material 270 eliminates any air gap and provides refractive index matching relative to the material of the glass of each container 131.

The examples also encompass technologies to provide good heat conductivity so as to facilitate dissipation of heat generated during operation of the LEDs 11. Hence, the system 130 includes one or more elements forming a heat dissipater within the housing for receiving and dissipating heat produced by the LEDs 11. Active dissipation, passive dissipation or a combination thereof may be used. The system 130 of FIG. 9, for example, includes a thermal interface layer 310 abutting a surface of the circuit board 170, which conducts heat from the LEDs and the board to a heat sink arrangement 333 shown by way of example as a number of fins within the housing 210. The housing 210 also has one or more openings or air vents 350, for allowing passage of air through the housing 210, to dissipate heat from the fins of the heat sink 333.

The thermal interface layer 310, the heat sink 333 and the vents 350 are passive elements in that they do not consume additional power as part of their respective heat dissipation functions. However, the system 130 may include an active heat dissipation element that draws power to cool or otherwise dissipate heat generated by operations of the LEDs 11. Examples of active cooling elements include fans, Peltier devices or the like. The system 130 of FIG. 9 utilizes one or more membronic cooling elements. A membronic cooling element comprises a membrane that vibrates in response to electrical power to produce an airflow. An example of a membronic cooling element is a SynJet® sold by Nuventix. In the example of FIG. 9, the membronic cooling element 370 operates like a fan or air jet for circulating air across the heat sink 333 and through the air vents 350.

In the orientation illustrated in FIG. 9, white light from the semiconductor nanophosphor excitation is dispersed upwards and laterally, for example, for omni-directional lighting of a room from a table or floor lamp. The orientation shown, however, is purely illustrative. The system 130 may be oriented in any other direction appropriate for the desired lighting application, including downward, any sideways direction, various intermediate angles, etc. In the example of FIG. 9, the glass bulb 133 produces a wide dispersion of output light, which is relatively omni-directional (except directly downward in the illustrated orientation). Of course, other bulb shapes may be used. Some bulbs may have some internal reflective surfaces, e.g. to facilitate a particular desired output distribution of the tunable white light.

The system 130 of FIG. 9 has one of several industry standard lamp bases 230, shown in the illustration as a type of screw-in base. The glass bulb 133 exhibits a form factor within standard size, and the output distribution of light emitted via the bulb 133 conforms to industry accepted specifications. Those skilled in the art will appreciate that these aspects of the system facilitate use of it as a replacement for existing systems, such as incandescent lamps and compact florescent lamps.

The housing 210, the base 230 and components contained in the housing 210 can be combined with a bulb and containers in a variety of different shapes. As such, these elements together may be described as a 'light engine' portion of the system. Theoretically, the engine alone or in combination with a standard sized set of the containers could be modular in design with respect to a variety of different bulb configuration, to allow a user to interchange glass bulbs, but in practice the lamp is an integral product. The light engine may be standardized across several different lamp product lines.

As outlined above, the system 130 will include or have associated therewith remote phosphors in multiple containers external to the LEDs 11 of the solid state source. As such, the phosphors are located apart from the semiconductor chip of the LEDs 11 used in the particular lamp 10, that is to say remotely deployed.

The phosphors are dispersed, e.g. in suspension, in a liquid or gaseous material 150, within a container (bulb 133 in the system of FIG. 9). The liquid or gaseous medium preferably exhibits high transmissivity and/or low absorption to light of the relevant wavelengths, although it may be transparent or somewhat translucent. Although alcohol, oils (synthetic, vegetable, silicon or other oils) or other media may be used, the medium may be a hydrocarbon material, in either a liquid or gaseous state.

In FIG. 9, the system is able to adjust or 'tune' the color of the white output light. The LEDs are used to pump the three separately contained semiconductor nanophosphors (R, G, and B). The system allows for the changing of intensity of emission of visible light by the three (R, G, B) separately contained phosphors. Changing the intensity of energy that the respective sources supply to the different housed phosphors changes the respective pumping energy supplied to the phosphors, which in turn changes the levels of excitation and thus changes the respective intensities of the emissions of the excited phosphors. The color or spectrum of energy of the emissions from the solid state source 11 is essentially the same (same rating although there may be variations with manufacturers' tolerances), but the phosphors are different (i.e. R, G, and B), separately contained and excited to independently controllable levels as in the earlier examples. The spectral characteristic of the output light, e.g. color temperature of the white light, varies with changes in the different relative levels of the light emissions from the three different phosphors.

The drive circuit may be programmed to vary color over time. Alternatively, the drive circuit may receive control signals modulated on the power received through the standard lamp base.

The sources 11 in the various examples discussed so far may be driven by any known or available circuitry that is sufficient to provide adequate power to drive the sources at the level or levels appropriate to the particular lighting application of each particular fixture and to adjust those levels to provide desired color tuning. Analog and digital circuits for controlling operations and driving the sources are contemplated. Those skilled in the art should be familiar with various suitable circuits. However, for completeness, we will discuss an example in some detail below.

Figure 11:
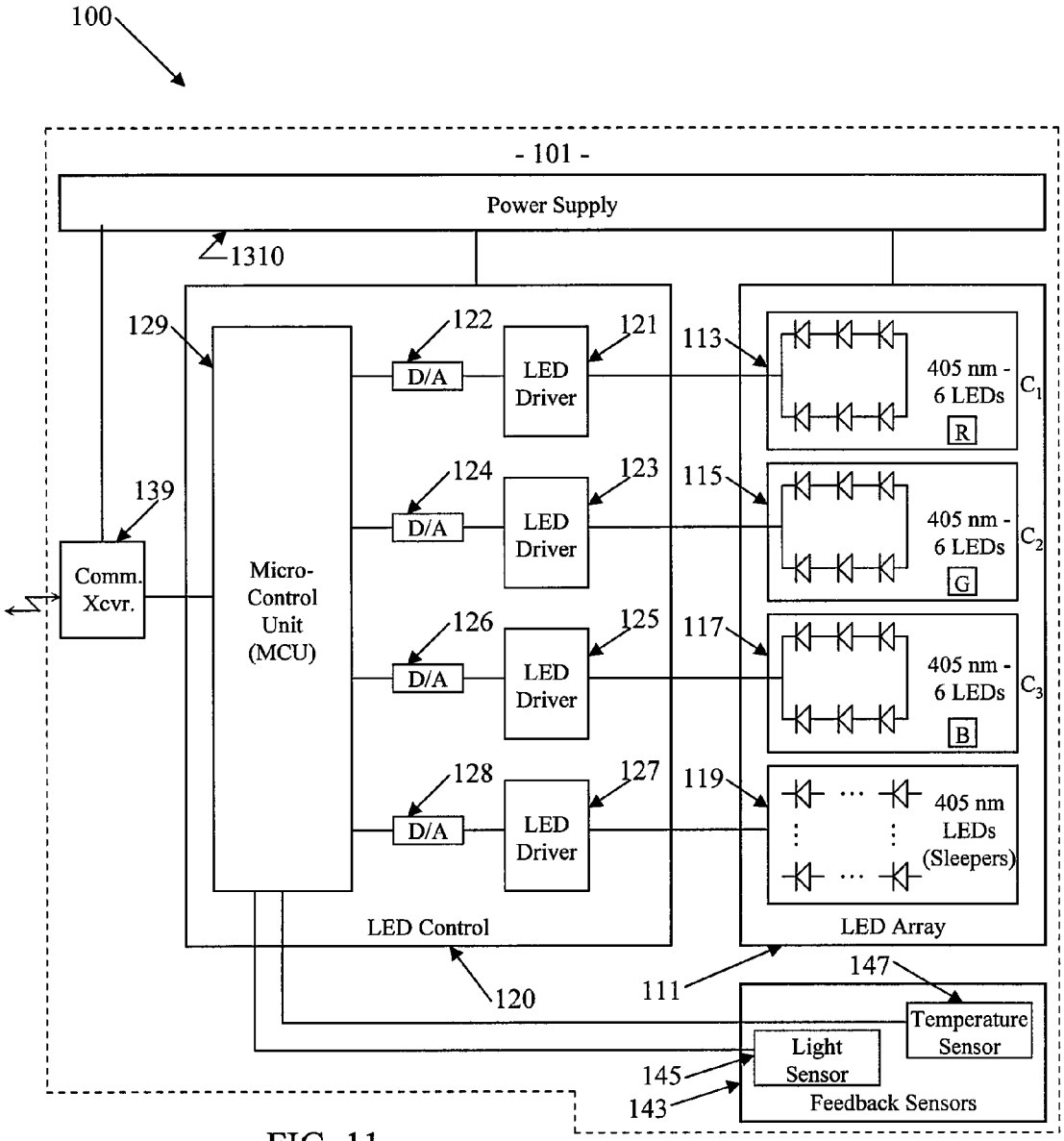
FIG. 11 is a functional block type circuit diagram, of an implementation of the system control circuit and LED array for a tunable white light emitting system.

An example of suitable circuitry, offering relatively sophisticated control capabilities, with reference to FIG. 11. A simpler circuit or a subset of such a circuit would more likely be included inside the lamp system of FIG. 9. That drawing figure is a block diagram of an exemplary tunable white light emission device 100, including the control circuitry and LED type sold state light sources. The LEDs and possibly some of the other electronic elements of the system could be incorporated into any of the device examples discussed above to form systems, with the LEDs shown in FIG. 11 serving as the various solid state sources 11. The circuitry of FIG. 11 provides digital programmable control of the tunable white light.

In the light engine 101 of FIG. 11, the set of solid state sources, such as those of near UV light takes the form of a LED array 111. In this example, the array 111 comprises 405 nm LEDs arranged in each of four different strings forming lighting channels C1 to C4 for pumping of RGB phosphors. The array 111 includes three initially active strings of LEDs, represented by LED blocks 113 (for pumping red nanophosphors), 115 (for pumping green nanophosphors) and 117 (for pumping blue nanophosphors).

The strings in this example have the same number of LEDs. LED blocks 113, 115 and 117 each comprises 6 LEDs. The LEDs may be connected in series, but in the example, two sets of 3 series connected LEDs are connected in parallel to form the blocks or strings of 6 405 nm near UV LEDs 113, 115, 117. The LEDs 113 may be considered as a first channel C1 to pump a red emitting nanophosphor in a first of the containers or light guides, the LEDs 115 may be considered as a second channel C2 for pumping green emitting nanophosphor in a second of the containers or light guides, whereas the LEDs 117 may be considered as a third channel C3 to pump a blue emitting nanophosphor in a third of the containers or light guides.

The LED array 111 in this example also includes a number of additional or 'other' LEDs 119. Some implementations may include various color LEDs, such as specific primary color LEDs, IR LEDs or UV LEDs, for various ancillary purposes. Another approach might use the LEDs 119 for a fourth channel of 405 nm LEDs to further control intensity of pumping another in a fourth of the containers or light guides. In the example, however, the additional LEDs 119 are 'sleepers.' Although shown for simplicity as a single group 119, there would likely be independently controllable sleepers 119 associated with each of the optical elements (light guides or containers) of a particular tunable lighting device. Initially, the LEDs 113-117 would be generally active and operate in the normal range of intensity settings, whereas sleepers 119 initially would be inactive. Inactive LEDs are activated when needed, typically in response to feedback indicating a need for increased output to pump one or more of the phosphors (e.g. due to decreased performance of one, some or all of the originally active LEDs 113-117). The set of sleepers 119 may include any particular number and/or arrangement of the LEDs as deemed appropriate for a particular application.

Strings 113, 115, and 117 may be considered a solid state light emitting element or 'source' coupled to supply near UV light so as to pump or excite the red, green, blue, nanophosphors, respectively. Each string comprises a plurality of light emitting diodes (LEDs) serving as individual solid state emitters. In the example of FIG. 11, each such element or string 113 to 117 comprises six of the 405 nm LEDs.

The electrical components shown in FIG. 11 also include a LED control system 120. The control system 121 includes LED driver circuits for the various LEDs of the array 111 as well as a micro-control unit (MCU) 129. In the example, the MCU 129 controls the LED driver circuits via digital-to-analog (D/A) converters. The driver circuit 121 drives the LEDs 113 of the first channel C1, the driver circuit 123 drives the LEDs 115 of the second channel C2, and the driver circuit 125 drives the LEDs 117 of the third channel C3. In a similar fashion, when active, the driver circuit 127 provides electrical current to the other LEDs 119.

Although current modulation (e.g. pulse width modulation) or current amplitude control could be used, this example uses constant current to the LEDs. Hence, the intensity of the emitted light of a given near UV LED in the array 111 is proportional to the level of current supplied by the respective driver circuit. The current output of each driver circuit is controlled by the higher level logic of the system, in this case, by the programmable MCU 129 via the respective A/D converter.

The driver circuits supply electrical current at the respective levels for the individual sets of 405 nm LEDs 113-119 to cause the LEDs to emit light. The MCU 129 controls the LED driver circuit 121 via a D/A converter 122, and the MCU 129 controls the LED driver circuit 123 via a D/A converter 124. Similarly, the MCU 129 controls the LED driver circuit 125 via a D/A converter 126. The amount of the emitted light of a given LED set is related to the level of current supplied by the respective driver circuit.

In a similar fashion, the MCU 129 controls the LED driver circuit 127 via the D/A converter 128. When active, the driver circuit 127 provides electrical current to the appropriate ones of the sleeper LEDs 119, for example, one or more sleeper LEDs associated with a particular optical element/phosphor of the lighting device.

In operation, one of the D/A converters receives a command for a particular level, from the MCU 129. In response, the converter generates a corresponding analog control signal, which causes the associated LED driver circuit to generate a corresponding power level to drive the particular string of LEDs. The LEDs of the string in turn output light of a corresponding intensity. The D/A converter will continue to output the particular analog level, to set the LED intensity in accord with the last command from the MCU 129, until the MCU 129 issues a new command to the particular D/A converter.

The control circuit could modulate outputs of the LEDs by modulating the respective drive signals. In the example, the intensity of the emitted light of a given LED is proportional to the level of current supplied by the respective driver circuit. The current output of each driver circuit is controlled by the higher level logic of the system. In this digital control example, that logic is implemented by the programmable MCU 129, although those skilled in the art will recognize that the logic could take other forms, such as discrete logic components, an application specific integrated circuit (ASIC), etc.

The LED driver circuits and the microcontroller 129 receive power from a power supply 1310, which is connected to an appropriate power source (not separately shown). For most general lighting applications, the power source will be an AC line current source, however, some applications may utilize DC power from a battery or the like. The power supply 1310 provides AC to DC conversion if necessary, and converts the voltage and current from the source to the levels needed by the LED driver circuits and the MCU 129.

A programmable microcontroller or microprocessor, such as the MCU 129, typically includes or has coupled thereto random-access memory (RAM) for storing data and read-only memory (ROM) and/or electrically erasable read only memory (EEROM) for storing control programming and any pre-defined operational parameters, such as pre-established light data for the current setting(s) for the strings of LEDs 113 to 119. The microcontroller 129 itself comprises registers and other components for implementing a central processing unit (CPU) and possibly an associated arithmetic logic unit. The CPU implements the program to process data in the desired manner and thereby generates desired control outputs. The microcontroller 129 is programmed to control the LED driver circuits 121 to 127 via the A/D converters 122 to 128 to set the individual output intensities of the 405 nm LEDs to desired levels, and in this circuit example to implement the spectral adjustment/control of the output light.

The electrical system associated with the fixture also includes a digital data communication interface 139 that enables communications to and/or from a separate or remote transceiver (not shown in this drawing) which provides communications for an appropriate control element, e.g. for implementing a desired user interface. A number of fixtures of the type shown may connect over a common communication link, so that one control transceiver can provide instructions via interfaces 139 to the MCUs 129 in a number of such fixtures. The transceiver at the other end of the link (opposite the interface 139) provides communications to the fixture(s) in accord with the appropriate protocol. Different forms of communication may be used to offer different links to the user interface device. Some versions, for example, may implement an RF link to a personal digital assistant by which the user could select intensity or brightness settings. Various rotary switches and wired controls may be used, and other designs may implement various wired or wireless network communications. Any desired medium and/or communications protocol may be utilized, and the data communication interface 139 may receive digital intensity setting inputs and/or other control related information from any type of user interface or master control unit.

To insure that the desired performance is maintained, the MCU 129 in this implementation receives a feedback signal from one or more sensors 143. A variety of different sensors may be used, alone or in combination, for different applications. In the example, the sensors 143 include a light intensity sensor 145 and a temperature sensor 147. A color sensor may be provided, or the sensor 145 may be of a type that senses overall light intensity as well as intensity of light in various bands related to different colors so that the MCU can determine color or spectral information from the measured intensities. The MCU 129 may use the sensed temperature feedback in a variety of ways, e.g. to adjust operating parameters if an excessive temperature is detected.

The light sensor 145 provides intensity information to the MCU 129. A variety of different sensors are available, for use as the sensor 145. In a cavity optic such as in the device 50 of FIG. 7, the light sensor 145 might be coupled to detect intensity of the integrated light either emitted through the aperture or as integrated within the cavity. For example, the sensor 145 may be mounted alongside the LEDs for directly receiving light processed within the optic. The MCU 129 uses the intensity feedback information to determine when to activate particular sleeper LEDs 119, e.g. to compensate for decreased performance of a respective set of LEDs for one of the initially active control channels C1 to C3. The intensity feedback information may also cause the MCU 129 to adjust the constant current levels applied to one or more of the strings 113 to 117 of 405 nm LEDs in the control channels C1 to C3, to provide some degree of compensation for declining performance before it becomes necessary to activate the sleepers.

Control of the near UV LED outputs could be controlled by selective modulation of the drive signals applied to the various LEDs. For example, the programming of the MCU 129 could cause the MCU to activate the A/D converters and thus the LED drivers to implement pulse width or pulse amplitude modulation to establish desired output levels for the LEDs of the respective control channels C1 to C3. Alternatively, the programming of the MCU 129 could cause the MCU to activate the A/D converters and thus the LED drivers to adjust otherwise constant current levels of the LEDs of the respective control channels C1 to C3. However, in the example, the MCU 129 simply controls the light output levels by activating the A/D converters to establish and maintain desired magnitudes for the current supplied by the respective driver circuit and thus the proportional intensity of the emitted light from each given string of LEDs. Proportional intensity of each respective string of LEDs provides proportional pumping or excitation of the phosphors coupled to the respective strings and thus proportional amounts of phosphor emissions in the output of the system.

For an ON-state of a string/channel, the program of the MCU 129 will cause the MCU to set the level of the current to the desired level for a particular spectral or intensity setting for the system light output, by providing an appropriate data input to the D/A converter for the particular channel. The LED light output is proportional to the current from the respective driver, as set through the D/A converter. The D/A converter will continue to output the particular analog level, to set the current and thus the LED output intensity in accord with the last command from the MCU 129, until the MCU 129 issues a new command to the particular D/A converter. While ON, the current will remain relatively constant. The LEDs of the string thus output near UV light of a corresponding relatively constant intensity. Since there is no modulation, it is expected that there will be little or no change for relatively long periods of ON-time, e.g. until the temperature or intensity feedback indicates a need for adjustment. However, the MCU can vary the relative intensities over time in accord with a program, to change the color tuning of the light output, e.g. in response to user input, based on time of day or in response to a sensor that detects ambient light levels.

Those skilled in the art will recognize that the phosphor-centric white light control in devices and systems that deploy phosphor remotely from the chips within the solid state sources, for general lighting applications and similar applications, may be used and implemented in a variety of different or additional ways.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting system for a white light application, comprising:

a first solid state source configured to emit electromagnetic energy in a narrow first spectrum, the first solid state source comprising a first semiconductor chip and a first enclosure about the first chip;

a first macro optical element positioned outside the first enclosure of the first solid state source and arranged to receive electromagnetic energy from the first solid state source;

a first phosphor remotely deployed in the first optical element at a location for excitation by the electromagnetic energy from the first solid state source, the first phosphor being of a type excitable by electromagnetic energy of the first spectrum and when excited for emitting visible light of a second spectrum different from and broader than the first spectrum, the first macro optical element comprising a first sealed container having a material bearing the first phosphor dispersed therein, the first sealed container comprising one or more internal surfaces forming an internal volume entirely containing the material bearing the first phosphor dispersed therein;

a second solid state source configured to emit electromagnetic energy in said first narrow spectrum, the second solid source comprising a second semiconductor chip and a second enclosure about the second chip;

a second macro optical element positioned outside the second enclosure of the second solid state source and arranged to receive electromagnetic energy from the second solid state source but to receive little or no electromagnetic energy from the first solid state source, wherein the first macro optical element is arranged to receive little or no electromagnetic energy from the second solid state source;

a second phosphor remotely deployed in the second macro optical element at a location for excitation by the electromagnetic energy from the second solid state source, the second phosphor being of a type excitable by electromagnetic energy of the first spectrum and when excited for emitting visible light of a third spectrum different from and broader than the first spectrum, the third spectrum also being different from the second spectrum, the second optical element comprising a second sealed container having a material bearing the second phosphor dispersed therein, the second sealed container comprising one or more internal surfaces forming an internal volume entirely containing the material bearing the second phosphor dispersed therein, wherein a visible light output of the lighting system includes a combination of light of the second spectrum from excitation of the first phosphor and light of the third spectrum from excitation of the second phosphors, from the first and second macro optical elements, and the visible light output of the lighting system is at least substantially white; and a controller coupled to the first and second solid state sources configured to enable adjustment of respective intensities of the electromagnetic energy of the first spectrum emitted by the first and second solid state sources to adjust relative levels of excitations of the first and second phosphors to control a spectral characteristic of the visible white light output of the lighting system.

2. The lighting system of claim 1, wherein for a set of respective intensities of the electromagnetic energy emitted by the first and second solid state sources established by the controller, the relative levels of excitations of the first and second phosphors produce visible white light output of the lighting system corresponding to a point on the black body curve.

3. The lighting system of claim 2, wherein:

the visible white light output of the lighting system corresponding to the point on the black body curve has a color rendering index (CRI) of 75 or higher, and the visible white light output of the lighting system corresponding to the point on the black body curve has a color temperature in one of the following ranges:

2,725±145° Kelvin;

3,045±175° Kelvin;

3,465±245° Kelvin; and 3,985±275° Kelvin.

4. The lighting system of claim 1, wherein each of the first and second solid state sources is a narrowband source having an emission rating wavelength $\lambda \leqq 460$ nm.

5. The lighting system of claim 4, wherein:

each of the phosphors has an upper limit of absorption around or below 430 nm; and the first and second solid state sources are narrowband sources each having an emission rating wavelength $\lambda \leqq 430$ nm.

6. The lighting system of claim 5, wherein the first and second solid state sources are narrowband sources each having an emission rating wavelength $\lambda$ around 405 nm.

7. The lighting system of claim 1, wherein each of the phosphors is a semiconductor nanophosphor.

8. The lighting system of claim 7, wherein each of the phosphors is a doped semiconductor nanophosphor.

9. The lighting system of claim 1, wherein:

the second and third spectra have little or no overlap with excitation spectra of the doped semiconductor nanophosphors;

the material bearing the first phosphor dispersed therein appears at least substantially clear when the first solid state source is off; and the material bearing the second phosphor dispersed therein appears at least substantially clear when the second solid state source is off.

10. The system of claim 9, wherein the second and third spectra have little or no overlap with excitation spectra of the doped semiconductor nanophosphors.

11. The lighting system of claim 9, wherein the material bearing the first phosphor dispersed therein and the material bearing the second phosphor dispersed therein are solids or liquids.

12. The lighting system of claim 9, wherein the material bearing the first phosphor dispersed therein and the material bearing the second phosphor dispersed therein are gases.

13. The lighting system of claim 12, wherein each of the gases comprises one gas or a combination of gases each selected from the group consisting of: hydrogen gas, inert gases and hydrocarbon based gases.

14. The lighting system of claim 1, wherein:

the container of the first optical element is formed of an optically transmissive material configured to act as a light guide with respect to electromagnetic energy received from the first solid state source and to allow diffuse emissions of light emitted by the first phosphor when excited; and the container of the second optical element is formed of an optically transmissive material configured to act as a light guide with respect to electromagnetic energy received from the second solid state source and to allow diffuse emissions of light emitted by the second phosphor when excited.

15. The lighting system of claim 1, further comprising:

a third solid state source configured to emit electromagnetic energy of said predetermined first spectrum;

a third optical element coupled to receive electromagnetic energy from the third solid state source, wherein: the third optical element is configured to receive little or no electromagnetic energy from the first and second solid state sources, and the first and second optical elements are configured to receive little or no electromagnetic energy from the third solid state source; and a third phosphor in the third optical element at a location for excitation by the electromagnetic energy from the third solid state source, the third phosphor being of a type excitable by electromagnetic energy of the first spectrum and when excited for emitting visible light of a fourth spectrum different from and broader than the first spectrum, the fourth spectrum being different from the second and third spectra, wherein the visible white light output of the system includes a combination of light emissions of the first, second and third phosphors when excited, from the first, second and third optical elements, and the controller is further coupled to the third solid state source and further configured to enable adjustment of the intensity of the electromagnetic energy of the first spectrum emitted by the third solid state source to adjust relative levels of excitations of the first, second and third phosphors to control the spectral characteristic of the visible white light output of the lighting system.

16. The lighting system of claim 1, further comprising:

an optical mixing element optically coupled to the first and second optical elements to receive and mix light emitted by the first and second phosphors when excited, from the first and second optical elements, to form the visible light output of the system.

17. The lighting system of claim 1, wherein the sources and the optical elements are configured in a form factor of a lamp.

18. The lighting system of claim 17, wherein the form factor is a form factor of an incandescent lamp.

19. The system of claim 17, wherein the form factor of the tube lamp is a form factor of a florescent tube lamp.

20. A solid state lighting device, comprising:

a first solid state source for emitting electromagnetic energy in a first narrow spectrum, the first solid state source comprising a semiconductor chip and an enclosure about the chip;

a first macro optical element positioned outside the enclosure of the first source and arranged to receive electromagnetic energy from the first solid state source;

a first phosphor remotely deployed in the first macro optical element at a location for excitation by the electromagnetic energy from the first solid state source, the first phosphor being of a type excitable by electromagnetic energy of the first spectrum and when excited for emitting visible light of a second spectrum different from and broader than the first spectrum;

a second solid state source for emitting electromagnetic energy in said first spectrum, the second solid state source comprising a second semiconductor chip and a second enclosure about the second chip;

a second macro optical element positioned outside the second enclosure of the second solid state source and arranged to receive electromagnetic energy from the second solid state source but to receive little or no electromagnetic energy from the first solid state source, wherein the first macro optical element is arranged to receive little or no electromagnetic energy from the second solid state source;

a second phosphor remotely deployed in the second macro optical element at a location for excitation by the electromagnetic energy from the second solid state source, the second phosphor being of a type excitable by electromagnetic energy of the first spectrum and when excited for emitting visible light of a third spectrum different from and broader than the first spectrum, the third spectrum also being different from the second spectrum, wherein:

a visible light output of the solid state lighting device includes a combination of light of the second spectrum from excitation of the first phosphor and light of the third spectrum from excitation of the second phosphors, from the first and second macro optical elements, the visible light output of the lighting system is at least substantially white, the first and second solid state sources are independently controllable so that the visible white light output of the solid state lighting device has a spectral characteristic determined by respective intensities of the electromagnetic energy of the first spectrum emitted by the first and second solid state sources to determine relative levels of excitations of the first and second phosphors, the first macro optical element comprises a first sealed container having a material bearing the first phosphor dispersed therein, the first sealed container comprising one or more internal surfaces forming an internal volume entirely containing the material bearing the first phosphor dispersed therein, and the second macro optical element comprises a second sealed container having a material bearing the second phosphor dispersed therein, the second sealed container comprising one or more internal surfaces forming an internal volume entirely containing the material bearing the first phosphor dispersed therein.

* * * * *